US009324554B2

(12) United States Patent
Guna

(10) Patent No.: US 9,324,554 B2
(45) Date of Patent: Apr. 26, 2016

(54) METHODS AND SYSTEMS FOR PROVIDING A SUBSTANTIALLY QUADRUPOLE FIELD WITH SIGNIFICANT HEXAPOLE AND OCTAPOLE COMPONENTS

(75) Inventor: Mircea Guna, Toronto, CA (US)

(73) Assignee: DH Technologies Development Pte. Ltd., Singapore (SG)

( * ) Notice: Subject to any disclaimer, the term of this patent is extended or adjusted under 35 U.S.C. 154(b) by 332 days.

(21) Appl. No.: 13/818,570

(22) PCT Filed: Aug. 25, 2011

(86) PCT No.: PCT/IB2011/001951

§ 371 (c)(1),
(2), (4) Date: Jun. 7, 2013

(87) PCT Pub. No.: WO2012/025821

PCT Pub. Date: Mar. 1, 2012

(65) Prior Publication Data

US 2013/0240724 A1 Sep. 19, 2013

Related U.S. Application Data

(60) Provisional application No. 61/376,851, filed on Aug. 25, 2010.

(51) Int. Cl.
*H01J 49/42* (2006.01)

(52) U.S. Cl.
CPC ..... *H01J 49/4285* (2013.01); *H01J 49/422* (2013.01); *H01J 49/4225* (2013.01)

(58) Field of Classification Search
CPC . H01J 49/4225; H01J 49/063; H01J 49/4265; H01J 49/427; H01J 49/4285; H01J 49/4215; H01J 49/422
See application file for complete search history.

(56) References Cited

U.S. PATENT DOCUMENTS

| | | | | |
|---|---|---|---|---|
| 5,089,703 | A * | 2/1992 | Schoen et al. | 250/292 |
| 6,075,244 | A | 6/2000 | Baba et al. | |
| 6,153,880 | A * | 11/2000 | Russ et al. | 250/292 |
| 6,177,688 | B1 | 1/2001 | Linthicum et al. | |
| 7,034,293 | B2 | 4/2006 | Wells | |
| 7,141,789 | B2 * | 11/2006 | Douglas et al. | 250/292 |
| 7,692,143 | B2 | 4/2010 | Guna | |
| 7,709,786 | B2 * | 5/2010 | Konenkov et al. | 250/282 |
| 8,168,944 | B2 * | 5/2012 | Guna | 250/282 |
| 2005/0067564 | A1 | 3/2005 | Douglas et al. | |
| 2008/0116372 | A1 | 5/2008 | Hashimoto | |
| 2008/0272295 | A1 * | 11/2008 | Mircea-Guna et al. | 250/292 |
| 2009/0032697 | A1 * | 2/2009 | Sugiyama et al. | 250/282 |
| 2010/0252730 | A1 * | 10/2010 | Green | H01J 49/4225 250/283 |

FOREIGN PATENT DOCUMENTS

WO 2011003186 A1 1/2011

OTHER PUBLICATIONS

International Search Report for PCT/IB2011/001951, mailed Feb. 17, 2012.
International Preliminary Report on Patentability and Written Opinion for PCT/IB2011/001951, mailed Feb. 26, 2013.

* cited by examiner

*Primary Examiner* — Brooke Purinton

(57) ABSTRACT

A system and method involving processing ions in a linear ion trap are provided, involving a two-dimensional asymmetric substantially quadrupole field having a hexapole and octopole component.

20 Claims, 10 Drawing Sheets

METHODS AND SYSTEMS FOR PROVIDING A SUBSTANTIALLY QUADRUPOLE FIELD WITH SIGNIFICANT HEXAPOLE AND OCTAPOLE COMPONENTS

CROSS REFERENCE TO RELATED APPLICATIONS

This application is a National Stage filing under 35 U.S.C. §371 of PCT/IB2011/001951 filed on Aug. 25, 2011, which designated the U.S., and which claims the benefit of U.S. Provisional Application Ser. No. 61/376,851 filed on Aug. 25, 2010, the contents of which are incorporated herein by reference in their entireties.

FIELD

The present invention relates to methods and systems for providing a substantially quadrupole field with significant hexapole and octapole components

INTRODUCTION

The performance of ion trap mass spectrometers can be limited by a number of different factors such as, for example, space charge density. Accordingly, improved mass spectrometer systems, as well as methods of operation, that address these limitations, are desirable.

SUMMARY

In accordance with an aspect of an embodiment of the present invention, there is provided a method of processing ions in a linear ion trap, the method comprising establishing and maintaining a two-dimensional asymmetric substantially quadrupole field having a first axis, a first axis potential along the first axis, a second axis orthogonal to the first axis and a second axis potential along the second axis, and then introducing ions to the field. The first axis potential comprises a quadrupole harmonic of amplitude a hexapole harmonic of amplitude $A3_1$ and an octapole harmonic of amplitude $A4_1$, wherein in various embodiments $A4_1$ is greater than 0.001% of $A2_1$, wherein in various embodiments $A4_1$ is greater than 0.01% of $A2_1$, $A4_1$ is less than 5% of $A2_1$ and 33% of $A3_1$, and for any other higher order harmonic with amplitude $An_1$ present in the first axis potential, $n_1$ being any integer greater than 4, $A3_1$ is greater than ten times $An_1$. The second axis potential comprises a quadrupole harmonic of amplitude $A2_2$, and an octapole harmonic of amplitude $A4_2$, wherein in various embodiments $A4_2$ is greater than 0.001% of $A2_2$, wherein in various embodiments $A4_2$ is greater than 0.01% of $A2_2$, $A4_2$ is less than 5% of $A2_2$ and, for any other higher order harmonic with amplitude $An_2$ present in the second axis potential of the field, $n_2$ being any integer greater than 2 except 4, $A4_2$ is greater than ten times $An_2$.

In accordance with an aspect of an embodiment of the present invention, $A3_1$ is greater than thirty times $An_1$. In accordance with an aspect of an embodiment of the present invention, $A3_1$ is greater than fifty times $An_1$.

In accordance with an aspect of an embodiment of the present invention, a method is provided wherein the linear ion trap comprises a first pair of rods, a second pair of rods and four auxiliary electrodes interposed between the first pair of rods and the second pair of rods and comprising a first pair of auxiliary electrodes and a second pair of auxiliary electrodes separated by a first plane bisecting one of the first pair of rods and the second pair of rods. The first axis lies in the first plane and the second axis is orthogonal to the first plane. Establishing and maintaining the field comprises providing a first RF voltage to the first pair of rods at a first frequency and in a first phase, a second RF voltage to the second pair of rods at a second frequency equal to the first frequency and in a second phase, opposite to the first phase, and an auxiliary RF voltage to the first pair of auxiliary electrodes at an auxiliary frequency equal to the first frequency and shifted from the first phase by a phase shift, a first DC voltage to the first pair of auxiliary electrodes, and a second DC voltage to the second pair of auxiliary electrodes. The method further comprises axially ejecting a selected portion of the ions from the field, the selected portion of the ions having a selected m/z, detecting the selected portion of the ions to provide a sliding mass signal peak centred about a sliding m/z ratio and adjusting at least one of the phase shift of the auxiliary RF voltage, the first DC voltage provided to the first pair of auxiliary electrodes, the second DC voltage provided to the second pair of auxiliary electrodes, and the auxiliary RF voltage provided to the first pair of auxiliary electrodes to slide the sliding m/z ratio toward the selected m/z.

In accordance with an aspect of an embodiment of the present invention, a method is provided wherein the linear ion trap comprises a first pair of rods, a second pair of rods and two auxiliary electrodes interposed between one of the first pair of rods and one of the second pair of rods and comprising a pair of auxiliary electrodes separated by a first plane bisecting either one of the first pair of rods or one of the second pair of rods. The first axis lies in the first plane and the second axis is orthogonal to the first plane. Establishing and maintaining the field comprises providing a first RF voltage to the first pair of rods at a first frequency and in a first phase, a second RF voltage to the second pair of rods at a second frequency equal to the first frequency and in a second phase, opposite to the first phase, and an auxiliary RF voltage to the first pair of auxiliary electrodes at an auxiliary frequency equal to the first frequency and shifted from the first phase by a phase shift, and a DC voltage to the pair of auxiliary electrodes. The method further comprises axially ejecting a selected portion of the ions from the field, the selected portion of the ions having a selected detecting the selected portion of the ions to provide a sliding mass signal peak centred about a sliding m/z ratio and adjusting at least one the phase of the auxiliary RF voltage, ii) the DC voltage provided to the pair of auxiliary electrodes, and iii) the auxiliary RF voltage provided to the pair of auxiliary electrodes to slide the sliding m/z ratio toward the selected m/z.

In various embodiments, the asymmetric substantially quadrupole generated comprises an X axis, separating one auxiliary electrode from the other electrode. In various embodiments, the asymmetric substantially quadrupole field generated comprises a Y axis, separating one auxiliary electrode from the other electrode.

In accordance with another aspect of an embodiment of the present invention, there is provided a linear ion trap system comprising i) a central axis, ii) a first pair of rods, wherein each rod in the first pair of rods is spaced from and extends alongside the central axis, iii) a second pair of rods, wherein the second pair of rods is spaced from and extends alongside the central axis, iv) four auxiliary electrodes interposed between the first pair of rods and the second pair of rods in an extraction region defined along at least part of a length of the first pair of rods and the second pair of rods, and v) voltage supplies connected to the first pair of rods, the second pair of rods and the four auxiliary electrodes. The four auxiliary electrodes comprise a first pair of auxiliary electrodes and a second pair of auxiliary electrodes, and the first pair of auxiliary electrodes are separated by, and are adjacent to, a single rod in either the first pair of rods or the second pair of rods. The voltage supplies are operable to provide i) a first RF voltage to the first pair of rods at a first frequency and in a first phase, ii) a second RF voltage to the second pair of rods at a second frequency equal to the first frequency and in a second phase, opposite to the first phase, iii) an auxiliary RF voltage to the first pair of auxiliary electrodes at an auxiliary frequency equal to the first frequency and shifted from the first phase by a phase shift, iv) a first DC voltage to the first pair of auxiliary electrodes, and v) a second DC voltage to the second pair of auxiliary electrodes.

In accordance with an aspect of an embodiment of the present invention, there is provided a linear ion trap system comprising a central axis, a first pair of rods, wherein each rod in the first pair of rods is spaced from and extends alongside the central axis, a second pair of rods, wherein each rod in the second pair of rods is spaced from and extends alongside the central axis, two auxiliary electrodes interposed between one of the first pair of rods and one of the second pair of rods in an extraction region defined along at least part of a length of the first pair of rods and the second pair of rods, wherein the two auxiliary electrodes comprise a pair of auxiliary electrodes, and the pair of auxiliary electrodes are separated by, and are adjacent to, a single rod from the first pair of rods and a single rod from the second pair of rods, and a voltage supply connected to the first pair of rods, the second pair of rods and the two auxiliary electrodes. The voltage supply is operable to provide i) a first RF voltage to the first pair of rods at a first frequency and in a first phase, ii) a second RF voltage to the second pair of rods at a second frequency equal to the first frequency and in a second phase, opposite to the first phase, iii) an auxiliary RF voltage to the pair of auxiliary electrodes at an auxiliary frequency equal to the first frequency and shifted from the first phase by a phase shift, and iv) a DC voltage to the first pair of auxiliary electrodes.

In various embodiments, the asymmetric substantially quadrupole field generated comprises an X axis, separating one auxiliary electrode from the other electrode. In various embodiments, the asymmetric substantially quadrupole field generated comprises a Y axis, separating one auxiliary electrode from the other electrode.

BRIEF DESCRIPTION OF THE DRAWINGS

A skilled person in the art will understand that the drawings, described below, are for illustration purposes only. The drawings are not intended to limit the scope of the Applicant's teachings in any way.

DETAILED DESCRIPTION

Figure 1:
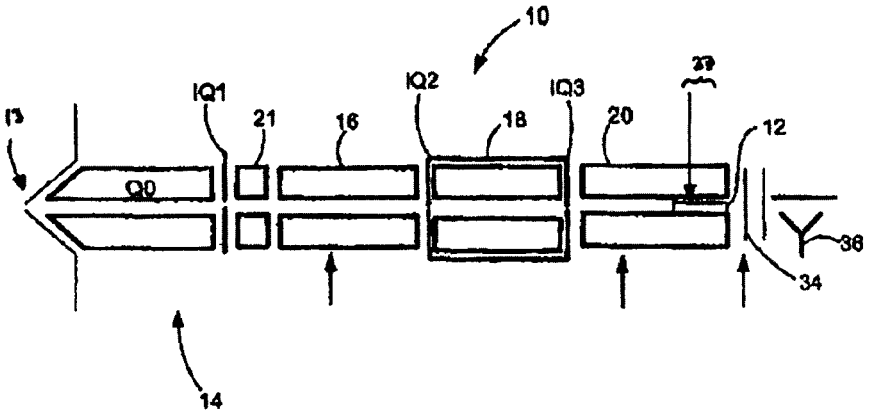
FIG. 1, in a schematic diagram, illustrates a Q-trap, Q-q-Q linear ion trap mass spectrometer system comprising auxiliary electrodes in accordance with an aspect of an embodiment of the present invention.

Referring to FIG. 1, there is illustrated in a schematic diagram, a QTRAP Q-q-Q linear ion trap mass spectrometer system 10 comprising auxiliary electrodes 12 in accordance with an aspect of an embodiment of the invention. During operation of the mass spectrometer, ions can be admitted into a vacuum chamber 14 through a skimmer 13. The linear ion trap 10 comprises four elongated sets of rods: Q0, a quadrupole mass spectrometer 16, a collision cell 18, and a linear ion trap 20, with plates after rod set between quadrupole mass spectrometer 16 and collision cell 18, and between collision cell 18 and linear ion trap 20. An additional set of stubby rods 21 can be provided between orifice plate IQ1 and quadrupole mass spectrometer 16.

In some cases, fringing fields between neighboring pairs of rod sets may distort the flow of ions. Stubby rods 21 can be provided between orifice plate IQ1 and quadrupole mass spectrometer 16 to focus the flow of ions into the elongated rod set Q1. Optionally, stubby rods can also be included upstream and downstream of the collision cell Q2.

Ions can be collisionally cooled in Q0, which may be maintained at a pressure of approximately $8\times10^{-3}$ torr. Quadrupole mass spectrometer 16 can operate as a conventional transmission RF/DC quadrupole mass spectrometer. In collision cell 18, ions can collide with a collision gas to be fragmented into products of lesser mass. Linear ion trap 20 can also be operated as a linear ion trap with or without mass selective axial ejection, more or less as described by Londry and Hager in the Journal of the American Association of Mass Spectrometry, 2003, 14, 1130-1147, and in U.S. Pat. No. 6,177,688, the contents of which are hereby incorporated by reference.

Ions can be trapped in linear ion trap 20 using radial RF voltages applied to the quadrupole rods and axial DC voltages applied to the end aperture lenses. In addition, as shown, linear ion trap 20 also comprises auxiliary electrodes 12.

As the ion population density increases within a linear ion trap, space charge effects can reduce mass accuracy. Thus, the operation of linear ion trap mass spectrometers can be limited by the space charge or the total number of ions that can be analyzed without affecting the analytical performance of the trap in terms of either mass accuracy or resolution.

In accordance with an aspect of an embodiment of the invention, auxiliary electrodes 12 can be used within linear ion trap 20 to create hexapole and octapole RF and electrostatic fields in addition to the main RF quadrupole field provided by the quadrupole rod array of the linear ion trap 20. The anharmonicity of these fields can change the dynamics of the ion cloud inside the ion trap during the ejection process and can reduce the deleterious effects of space charge to improve mass accuracy. These auxiliary electrodes can be used in contexts different from those shown in FIG. 1, the set up of FIG. 1 being shown for illustrative purposes only. For example, such a non-linear ion trap could be used as a precursor ion selector in a tandem MS/MS system, such as a triple quadrupole, or trap-, as a product ion analyzer in a MS/MS configuration or as a stand alone mass spectrometer.

Figure 2:
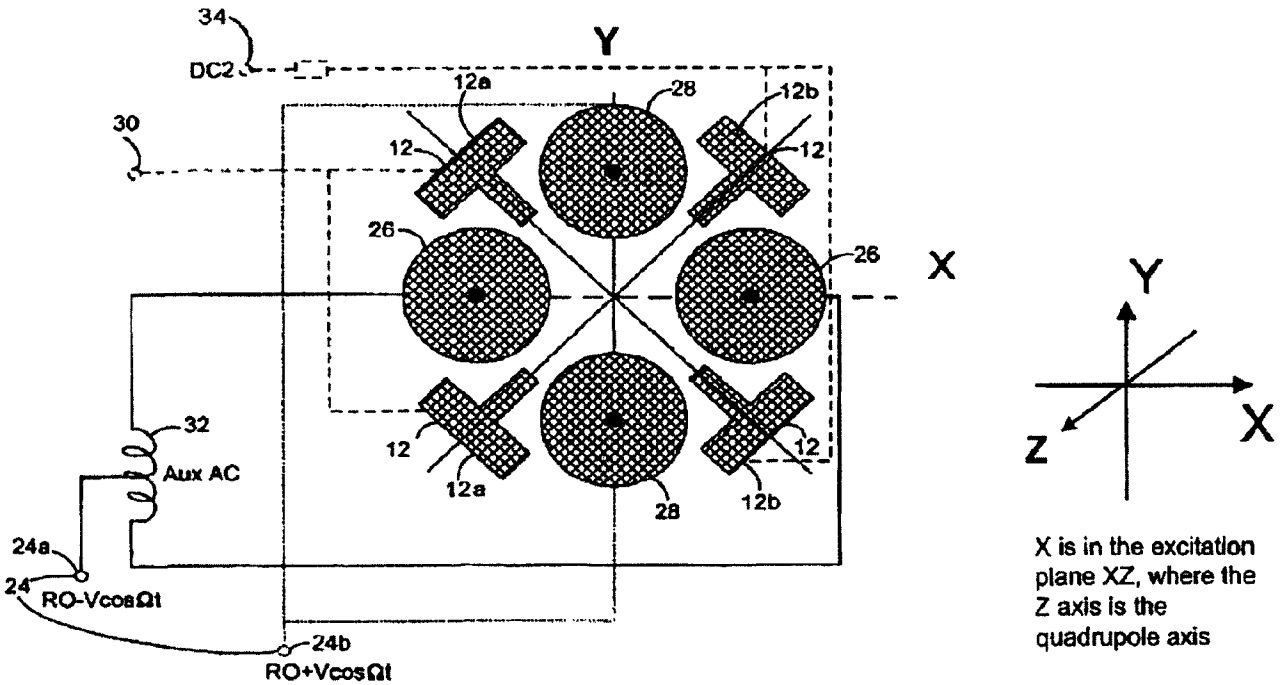
FIG. 2, in a schematic sectional view, illustrates the auxiliary electrodes and rods of a linear ion trap of a variant of the linear ion trap mass spectrometer system of FIG. 1.

FIG. 1 shows a possible axial position of the auxiliary electrodes 12 within the linear ion trap 20. Specifically, the auxiliary electrodes within an extraction region of the linear ion trap 20. In some embodiments, such as the embodiment of FIG. 1, the extraction region extends over less than half the length of the linear ion trap 20. Referring to FIG. 2, the radial position of a particular variant of the auxiliary electrodes 12 relative to the linear ion trap 20 is shown. In the variant of FIG. 2, the auxiliary electrodes 12 are electrodes comprising a rectangular base section spaced from the central axis of the linear ion trap 20, and a rectangular top section extending toward the central axis of the linear ion trap 20 from the rectangular base section. As will be apparent to those of skill in the art, other electrode configurations could also be used. For example, without limitation, the rectangular top section of the electrodes might be retained, but some other means, other than the rectangular base section, could be used to mount this rectangular top section. Alternatively, the electrodes in their entirety could be replaced with cylindrical electrodes. In such an embodiment, the cylindrical electrodes would typically have smaller radii than the radii of the main rods 26, 28.

In the variant of FIG. 2, a main drive voltage supply 24 can supply a drive RF voltage, V cos Ωt, as shown. As is known in the art, the voltage supply 24 can comprise a first RF voltage source 24*a* for providing a first RF voltage, −V cos Ωt, to the first pair rods 26 at a first frequency Ω, and in the first phase, while the voltage supply 24 can also comprise a second RF voltage source operable to provide a second RF voltage, V cos Ωt, to the second pair of rods 28, again at the first frequency Ω, but opposite in phase to the first voltage applied to the first pair of rods 26. While in the variants shown in FIG. 2, the magnitude of the RF voltage provided to both the first pair of rods 26 and the second pair of rods 28 is the same, optionally, in some embodiments, these voltages may differ by up to 10%.

As shown, the voltage supply 24 also provides a rod offset voltage to the rods, which can be equal for both the first pair of rods and the second pair of rods 28. Typically, this rod offset voltage RO is a DC voltage opposite in polarity to the ions being confined within the linear ion trap.

As shown in FIG. 2, auxiliary electrodes 12 comprise auxiliary electrode pair 12*a* to the left of the Y axis, and auxiliary electrode pair 12*b* to the right of the Y axis. Auxiliary electrodes 12*a* can be coupled to a separate or independent power supply 30, while auxiliary electrodes 12*b* can be coupled to a second independent power supply 34. As shown, the second independent power supply 34 supplies only a DC voltage, DC2, to auxiliary electrodes 12*b*, while independent power supply 30 supplies a DC voltage, to electrodes 12*a*, together with an RF voltage component U cos of the same periodicity or frequency as the RF voltage (V cos Ωt) provided to the main electrodes or rods 26 or 28. As shown, the RF voltage applied to the auxiliary electrodes 12*a* has been phase shifted by 4) relative to the voltage provided to the main electrodes 26 and 28. This phase shift can be provided by a phase controller, which, in some embodiments, can be a phase variable all-pass filter coupled to a downstream RF amplifier.

Also as shown in FIG. 2, a dipolar excitation AC voltage can be provided by, say, an auxiliary AC voltage source 32, to the first pair of rods 26 to provide a dipolar excitation signal to provide axial ejection, as described, for example, in U.S. Pat. No. 6,177,688. Optionally, the selected excited by the dipolar excitation signal can be axially ejected past 33 (shown in FIG. 1) to a detector 36 to generate a mass spectrum. Alternatively, these ions can be transmitted to downstream rod sets for further processing. For example, the ions could be fragmented and analyzed in a downstream mass spectrometer. As is known in the art, the AC voltage provided by the auxiliary voltage source 32 can often be at a much lower frequency than the first frequency Ω.

By providing the auxiliary electrodes 12*a* and 12*b* in the asymmetrical configuration shown in FIG. 2, relative to the rods and shifted voltage applied to only the auxiliary electrodes 12*a*, and not to the auxiliary electrodes 12*b*, a two-dimensional asymmetric substantially quadrupole field can be provided. This asymmetric substantially quadrupole field comprises an X axis, separating one auxiliary electrode 12*a* from the other electrode 12*a*, and a Y axis separating auxiliary electrodes 12*a* from auxiliary electrodes 12*b*, as shown in FIG. 2. The X axis and the Y axis intersect at the both the linear ion trap 20, and the linear ion trap mass spectrometer system 10. In the embodiment of FIG. 2, the X axis or first axis can also be called the excitation plane as the dipolar excitation from auxiliary AC voltage source 32 can be provided to only the first pair of rods 26, which are bisected by this first X axis, and not to the second pair of rods 28.

By applying voltages in the asymmetric manner described above, different potentials can be provided along the X axis and Y axis of the two-dimensional field to provide the asymmetry. That is, the potential on the X axis may comprise, in addition to the quadrupole component, dodecapole, decapole, octapole, hexapole and dipole components. The hexapole component $A3_x$ can be the strongest higher order component, being at least three times stronger than the octapole component $A4_x$ and more than 50 times stronger than higher multipoles $An_x$, where n is an integer greater than 4. The dipole component can be about ten times stronger than the hexapole component $A3_x$.

In contrast, the potential on the Y-axis can comprise, in addition to the main quadrupole component $A2_y$ mainly an octapole component $A4_y$, every other higher order component ($A3_y$ and $An_y$, $n_y$ being an integer greater than 4) having an amplitude less than 5% of the octapole component $A4_y$.

The maximum values for these multipole components can be obtained when the phase difference is either 0 or + or −180°. The phase ϕ can determine the polarity of the additional multipole components contributing to the field inside the quadrupole or linear ion trap 20 as well as the actual ratio between each field component and the main quadrupole field. Experimental results indicate that a phase shift of approximately 60° provides a good space charge tolerance. However, depending on electrode alignment, optimal phase shifts can vary between systems to some extent. Further, due to electrical interferences, and probe capacitance, the actual ϕ value might differ from this measured value.

Optionally, the phase shift can be tuned to higher values from the optimum phase shift described above to provide superior peak resolution, at the price of reduced sensitivity. At a higher phase shift, the amplitude of the RF on the auxiliary electrodes 12*a* can be increased without a loss in mass accuracy. For example, at a phase shift of 160°, and an RF amplitude, U, 75% higher than the optimal value, resolution can be increased by a factor of 2, while sensitivity can drop by 40%, at a mass range of 200 Da to 300 Da.

In addition, the balance of the main RF (that is the relative magnitudes of the first RF voltage and the second RF voltage—these two magnitudes need not be the same) can also play a role in defining the range of the optimum phase shift and RF amplitude provided to the auxiliary electrodes to achieve a particular trade-off between mass resolution and sensitivity, for a specific mass.

Also, the optimum RF voltage applied to the auxiliary electrodes 12 as well as the phase shift relative to the main drive RF voltage applied to the main rods 26, 28 can depend not only on the RF balance on the quadrupole array but also on the excitation q or the frequency Ω. In the foregoing examples, excitation q was 0.823. Experimentally it has been observed that when the excitation q was changed from 0.823 to 0.742 the desired phase shift for mass accuracy varied by 37 degrees. More precisely, the desired phase shift increased by 37 degrees. More generally, the phase shift may be adjusted to improve mass accuracy when one or more of the following variables are changed: i) a magnitude of the first RF voltage; i) a magnitude of the second RF voltage; and, iii) the first frequency of the first RF voltage (which is also the second frequency of the second RF voltage).

Using a dipolar auxiliary signal, ions were excited at their fundamental secular frequency where Ω is the angular frequency of the RF and β is a function of the Mathieu stability parameters a and q as described, for example, in U.S. Pat. No. 7,034,293, the contents of which are hereby incorporated by reference.

When the voltage applied to the rods 26 and 28 (see FIG. 2) is V cos Ωt and RO+V cos Ωt), respectively, the Mathieu parameters a and q are given by $$a=0; \text{ and}$$

$$q=2zV/(4m\,\Omega^2 r_0^2)$$

where V is the zero to peak amplitude of a sinusoidal voltage of angular frequency Ω.

In the foregoing description, $\omega_0$ is the frequency in the case when the nonlinear components are not taken into consideration as contributors. Due to the presence of higher order terms, such as the hexapole and octapole, the ion secular frequency can shift and the shift can vary with the amplitude of the radial motion of the ions.

Figure 3:
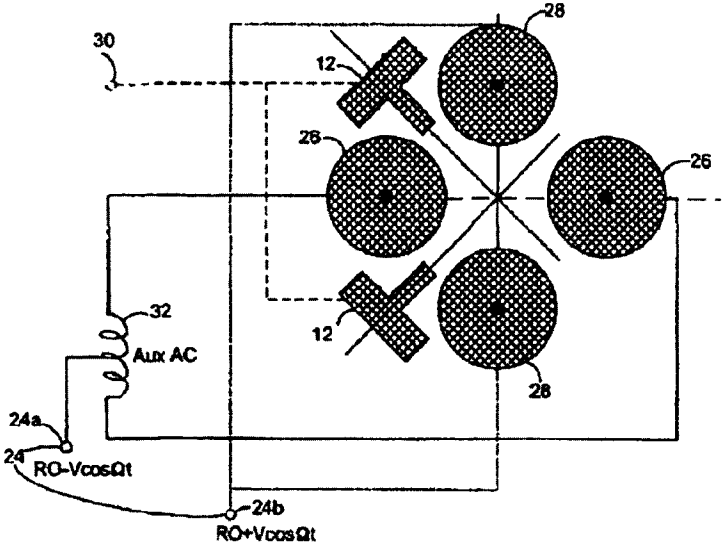
FIG. 3, in a schematic sectional view, illustrates the auxiliary electrodes and rods of a linear ion trap of a second variant of the linear ion trap mass spectrometer system of FIG. 1.

Referring to FIG. 3, there is illustrated, in a schematic section view, auxiliary electrodes 12 and rod pairs 26 and 28 of a quadrupole linear ion trap in accordance with a variant of the linear ion trap mass spectrometer system 10 of FIG. 1. For clarity, the same reference numerals are used to designate like elements of the auxiliary electrodes and rods shown in both FIGS. 2 and 3. For brevity, the description of FIG. 2 is not repeated with respect to FIG. 3.

In the variant of FIG. 3, auxiliary electrodes 12 comprise two electrodes or one pair of electrodes. The voltages applied to the auxiliary electrodes 12 and the rod pairs 26 and 28 in a similar fashion as in the variant from FIG. 2, except that the DC1 and DC2 voltages are replaced with one DC voltage. The asymmetric substantially quadrupole field generated in the configuration comprises an X axis, separating one auxiliary electrode 12 from the other electrode 12.

Figure 4:
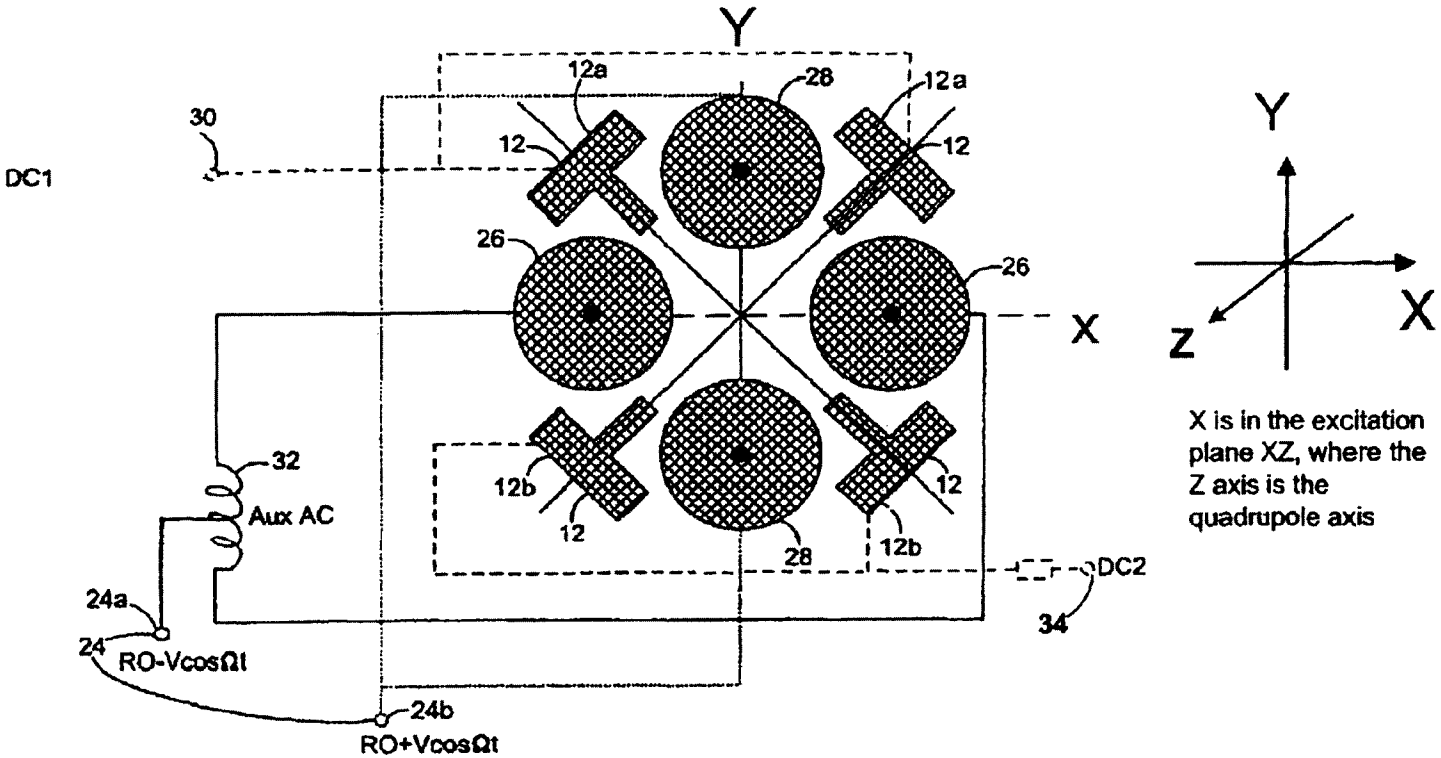
FIG. 4 in a schematic sectional view, illustrates the auxiliary electrodes and rods of a linear ion trap in accordance with various embodiments of the linear ion trap mass spectrometer system of FIG. 1.

Referring to FIG. 4, there is illustrated, in a schematic section view, auxiliary electrodes 12 and rod pairs 26 and 28 of a quadrupole linear ion trap in accordance with a variant of the linear ion trap mass spectrometer system 10 of FIG. 1. For clarity, the same reference numerals are used to designate like elements of the auxiliary electrodes and rods shown in both FIGS. 2 and 3. For brevity, the description of FIG. 2 is not repeated with respect to FIG. 4.

In the variant of FIG. 4, a main drive voltage supply 24 can again provide a drive RF voltage, V cos Ωt, as shown. As is known in the art, the voltage supply 24 can comprise a first RF voltage source 24*a* for providing a first RF voltage, −V cos Ωt, to the first pair of rods 26 at a first frequency Ω, and in the first phase, while the voltage supply 24 can also comprise a second RF voltage source 24*b* operable to provide a second RF voltage to the second pair of rods 28, again at the first frequency SI, but opposite in phase to the first voltage applied to the first pair of rods 26.

As shown, the voltage supply 24 can also provide a rod offset voltage RO to the rods, which can be equal for both the first pair of rods 26 and the second pair of rods 28. Typically, this rod offset voltage RO is a DC voltage opposite in polarity to the ions being confined within the linear ion trap.

As shown in FIG. 4, auxiliary electrodes 12 can comprise auxiliary electrode pair 12*a* above the X axis, and auxiliary electrode pair 12*b* below the X axis. In other words, in the variant of FIG. 4, unlike the variant of FIG. 2, the auxiliary electrode pair 12*a* is separated from the auxiliary electrode pair 12*b* by the X axis, instead of the Y axis. Auxiliary electrodes 12*a* can be coupled to a separate or independent power supply 30, while auxiliary electrodes 12*b* can be coupled to a second independent power supply 34. As shown, the second independent power supply 34 supplies only a DC voltage, DC2, to auxiliary electrodes 12*b*, while independent power supply 30 supplies a DC voltage to electrodes 12*a*, together with an RF voltage component U cos(ϕ) of the same periodicity or frequency as the RF voltage (V cos Ωt) provided to the main electrodes or rods 26 or 28. As shown, the RF voltage applied to the auxiliary electrodes 12*a* has been phase shifted by ϕ relative to the RF voltage provided to the main electrodes 26 and 28.

A dipolar excitation AC voltage can be provided by, say, an auxiliary AC voltage source 32, to the first pair of rods 26 to provide a dipolar excitation signal to provide axial ejection. Optionally, the selected ions that are excited by the dipolar excitation signal can be axially ejected past an axial lens 33 (shown in FIG. 1) to a detector 36 to generate a mass spectrum. Alternatively, these ions can be transmitted to downstream rod sets for further processing. Alternatively, the ions could be fragmented and analyzed in a downstream mass spectrometer. As is known in the art, the AC voltage provided by the auxiliary voltage source 32 can often be at a much lower frequency than the first frequency Ω.

By providing the auxiliary electrodes 12*a* and 12*b* in the asymmetrical configuration shown in FIG. 4 but with a phase shifted voltage applied to only the auxiliary electrodes 12*a*, and not to the auxiliary electrodes 12*b*, a two-dimensional asymmetric substantially quadrupole field can be provided. This asymmetric substantially quadrupole field comprises an X axis separating auxiliary electrodes 12*a* from auxiliary electrodes 12*b*, and a Y axis separating one auxiliary electrode 12*a* from the other auxiliary electrode 12*a*, as shown in FIG. 4.

By applying voltages in the asymmetric manner described above, different potentials can be provided along the X axis and the Y axis of the two-dimensional field to provide the asymmetry. That is, the potential on the Y axis can comprise, in addition to the main quadrupole component, dodecapole, decapole, octapole, hexapole and dipole components. The hexapole component $A3_y$ can be the strongest higher order component, being at least three times stronger than the octapole component $A4_y$ and more than 50 times stronger than higher multipoles $An_y$, where $n_y$ is an integer greater than 4.

The dipole component can be about ten times stronger than the hexapole component $A3_y$. In contrast, the potential on the X-axis can comprise, in addition to the main quadrupole component $A2_x$ mainly an octapole component $A4_x$, every other higher order component ($A3_x$, and $An_y$, $n_x$ being an integer greater than 4) having amplitudes less than 5% of the octapole component $A4_x$.

The relative purity of the field that can be generated, in that it is substantially limited to quadrupole, hexapole and octapole components, at least partly as a consequence of the symmetry of the linear ion trap 20 in the extraction region comprising auxiliary electrodes 12, together with the limited asymmetry of the voltages provided as described above. That is, as shown in FIGS. 2 and 4, at any point along the central axis of the extraction region of a linear ion trap 20, shown in FIG. 1, an associated plane orthogonal to the central axis intersects the central axis, intersects the first pair of rods 26 at an associated first pair of cross sections (marked as 26 in FIGS. 2 and 4) and intersects the second pair of rods 28 at an associated second pair of cross sections (marked as 28 in FIGS. 2 and 4). This associated first pair of cross section 26 are substantially symmetrically distributed about the central axis and are bisected by the X axis lying in the associated plane orthogonal to the central axis and passing through a center of each cross section 26 in the first pair of cross sections 26. The associated second pair of cross sections 28 are substantially symmetrically distributed about the central axis and are bisected by the Y axis lying in the associated plane orthogonal to the central axis and passing through a center of each cross section 28 in the second pair of cross sections 28. The X axis and the Y axis are substantially orthogonal and intersect at the central axis.

At any point along the central axis in the extraction region, the associated plane orthogonal to the central axis intersects the first pair of auxiliary electrodes 12*a* at a first pair of auxiliary cross sections (marked 12*a* in FIGS. 2 and 4) and intersects the second pair of auxiliary electrodes 12*b* at an associated second pair of auxiliary cross sections (designated 12*b* in FIGS. 2 and 4). In the first configuration of FIG. 2, the associated first pair of auxiliary cross sections 12*a* are substantially symmetrically distributed about the X axis (the first axis in this embodiment) and one cross-section in the first pair of cross-sections. In this configuration, the associated second pair of auxiliary cross sections 12*b* are also substantially symmetrically distributed about the X axis and the other cross-section in the first pair of cross-sections.

In the second configuration of FIG. 4, the associated first pair of auxiliary cross sections 12*a* are substantially symmetrically distributed about the Y axis (the first axis in this embodiment) and one cross-section in the second pair of cross-sections, while the associated second pair of auxiliary cross sections 12*b* are substantially symmetrically distributed about the Y axis and the other cross-section in the second pair of cross-sections.

Figure 5:
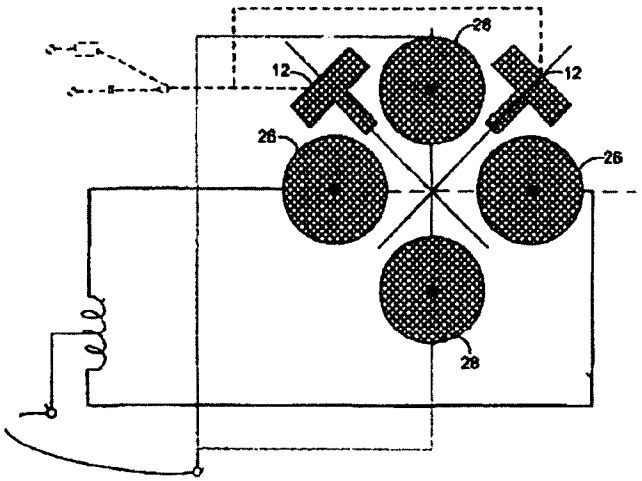
FIG. 5, in a schematic sectional view, illustrates the auxiliary electrodes and rods of a linear ion trap in accordance with various embodiments of the linear ion trap mass spectrometer system of FIG. 1.

Referring to FIG. 5, there is illustrated, in a schematic section view, auxiliary electrodes 12 and rod pairs 26 and 28 of a quadrupole linear ion trap in accordance with a variant of the linear ion trap mass spectrometer system 10 of FIG. 1. For clarity, the same reference numerals are used to designate like elements of the auxiliary electrodes and rods shown in both FIGS. 2, 3 and 4. For brevity, the description of FIG. 4 is not repeated with respect to FIG. 5.

In the variant of FIG. 5, auxiliary electrodes 12 comprise two electrodes or one pair of electrodes. The voltages applied to the auxiliary electrodes 12 and the rod pairs 26 and 28 in a similar fashion as in the variant from FIG. 4, except that the DC1 and DC2 voltages are replaced with one DC voltage. The asymmetric substantially quadrupole field generated in configuration comprises an Y axis, separating one auxiliary electrode 12 from the other electrode 12.

Auxiliary Electrode Voltages

When a DC voltage provided to the auxiliary electrodes 12 by the independent power supply 30 is lower than the rod offset RO voltage, and when a barrier voltage applied to the exit lens 33 is higher than RO, ions can accumulate in the extraction region of the linear ion trap 20 containing the auxiliary electrodes 12. Once the ions have accumulated in the extraction region of the linear ion trap 20, collar electrodes (not shown) at the upstream end of the auxiliary electrodes, toward the middle of the linear ion trap 20, can be provided with a suitable barrier voltage for confining the ions within the extraction region, even if, as will be described below in more detail, the DC voltage applied to the auxiliary electrodes is raised above the rod offset voltage.

Specifically, the DC field created by the auxiliary electrodes 12 can have a double action. First, as described above, this DC field can create an axial trap to attract, and to some extent, contain ions within the extraction region of the linear ion trap 20. In addition, the DC field created by the auxiliary electrodes can introduce radial hexapole and octapole electrostatic fields that can change the dynamics of the ion cloud, radially. A strength of these fields can be varied by, for example, varying the voltage applied to the electrodes, or changing the depths of the rectangular top sections of the T-electrodes. Optionally, other approaches could also be used, such as by providing segmented auxiliary electrodes, the segments being configured to provide different voltages at different points along their length, or, say, by having the auxiliary electrodes diverge or converge relative to the central axis of the linear trap 20. Similarly, the strength of the non-linear RF fields introduced by the auxiliary electrodes 12 can be adjusted by adjusting RF voltage component $U\cos(\Omega t+\phi)$, or by changing or tapering the depth of the T-profile of the auxiliary electrodes 12.

It may be desirable to adjust the magnitude of the auxiliary RF voltage applied to two of the auxiliary electrodes 12 relative to the magnitude, V, of the RF voltages applied to the main rods. Specifically, it may be desirable to increase the proportion of RF provided to the auxiliary electrodes 12 as the scan speed is increased, although, in many embodiments, a higher magnitude of RF applied to the auxiliary electrodes 12 may also work for slower scan speeds.

In various embodiments, the amplitude of the DC voltages, DC1 and DC2, provided to the auxiliary electrodes 12, can be selected to be in a pre-desired range corresponding to a particular mass range and/or mass ranges of ions to be ejected as well as scan rate of the mass selective axial ejection. Optionally, DC1, DC2, U or V may be varied over time to different levels depending upon the mass-to-charge ratio of the ions being scanned. For example, a first setting for DC1, DC2, U and V can be set at a predetermined level for ions within a first mass-to-charge ratio range. Suitable levels of DC1, DC2, U and V could be determined, for example, by axial ejection of a ion within or close to this first mass-to-charge ratio range. Then, after ions within this first mass-to-charge ratio range have been axially ejected or scanned, the levels of DC1, DC2, U and V can be adjusted to scan or axially eject ions within a second mass-to-charge ratio range, different from the first mass-to-charge ratio range. Again, suitable levels of DC1, DC2, U and V for the second mass-to-charge ratio range can be determined by axial ejection or scanning of a second calibrant ion within, or close to, the second mass-to-charge ratio range.

One example of ion path voltages for mass spectrometer system 10 of FIG. 1, while the ion trap 20 is being filled, is described below. In the description that follows, the RF voltage is provided to the auxiliary electrodes 12*a*, to one side of the Y axis and separated from each other by the X axis, according to the first configuration of FIG. 2. In this example, a rod offset voltage of approximately −40V can be maintained for the rods of the collision cell 18, while IQ3 can be kept at a voltage of −40.5V. In general, the voltage of can be approximately 0.5V less than the offset voltage of the collision cell 18. Optionally, the linear ion trap mass spectrometer system 10 of FIG. 1 can include a pair of stubby rods ST3 (not shown) downstream of IQ3 and upstream of linear ion trap 20. In such an embodiment, the stubby rods can be kept at a voltage that is 5V less than the rod offset voltage of the collision cell 18, or, in this case, a voltage of −45V. Main rods 26 and 28 of linear ion trap mass spectrometer system 10 can be maintained at a rod offset voltage that is 8V less than the rod offset voltage of the rods of the collision cell 18, such that in this case the rods 26 and 28 can have a rod offset voltage of −48V. In this case, the DC1, applied to the auxiliary electrodes 12*a* according to the first configuration of FIG. 2 can be −100V, as can DC2, applied to the auxiliary electrodes 12*b*. Downstream of the linear ion trap 20, exit lens 33 can be maintained at a voltage of 100V, while detector 36 can be maintained at a voltage of −6 kV.

During cooling, DC1 and DC2 voltages can be dropped to −170V, while the rod offset voltage applied to the rods 26, 28 of the linear ion trap 20 can be dropped first to −80V, then to −100V, and finally, 10 ms before the scan, voltage can be dropped to −160V.

During mass selective axial ejection, the rod offset voltage of the collision cell 18 can be set to −200V, while IQ3 can be set to 100V. The optional stubby rods downstream of the collision cell 18 and upstream of the linear ion trap 20 can be set at a voltage of 100V, while the rod offset voltage of the rods 26, 28 can be set to −160V. Again, according to the first configuration of FIG. 2, can be set to a voltage of −160V, while DC2 can be set to a voltage of −165V. The exit lens 33 can be maintained at a voltage of −146V, while the detector can be maintained at a voltage of −6 kV. The DC2 voltage can be varied with mass. In this case, the mass of interest was in the range. Higher mass to charge ratios can require more negative values. The collar voltage in this case was 1000V.

Experimental Data

In accordance with an aspect of an embodiment of the present invention, ions in a 10 Dalton window around mass 322 Daltons can be transmitted through quadrupole mass spectrometer 16 operated as a mass filter, and then fragmented at a collision energy of 27 eV in a collision cell 18. All of the fragments and unfragmented precursor ions can then be trapped in the downstream ion trap 20, where they can be cooled over a cooling time. After this cooling time, the ions can be mass selectively ejected from the trap 20 toward a detector 35 and mass spectra can be acquired.

Figure 6A:
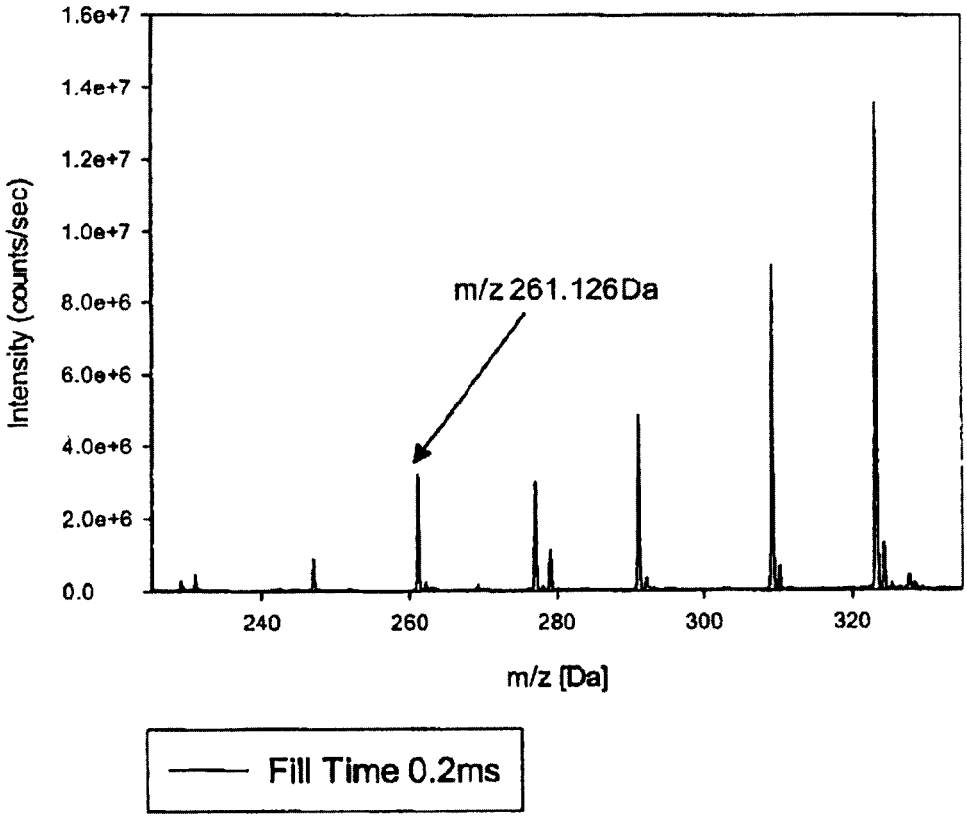
FIG. 6*a* illustrates a full mass spectra generated using the linear ion trap mass spectrometer system of FIG. 1 with a fill time of 0.2 ms.

Referring to FIG. 6*a*, a full spectra is shown for a fill time of the linear ion trap 20 of 0.2 ms. Except for very high mass intensities, for a fill time this short, there may well be no significant space charge density effects. However, as the fill time is increased, space charge density effects can shift the densities measured along the X axis. To mitigate this, DC and auxiliary RF voltages can be provided to the auxiliary electrodes 12 according to either the configuration of FIG. 2, 3, 4 or 5, for example.

Figure 6B:
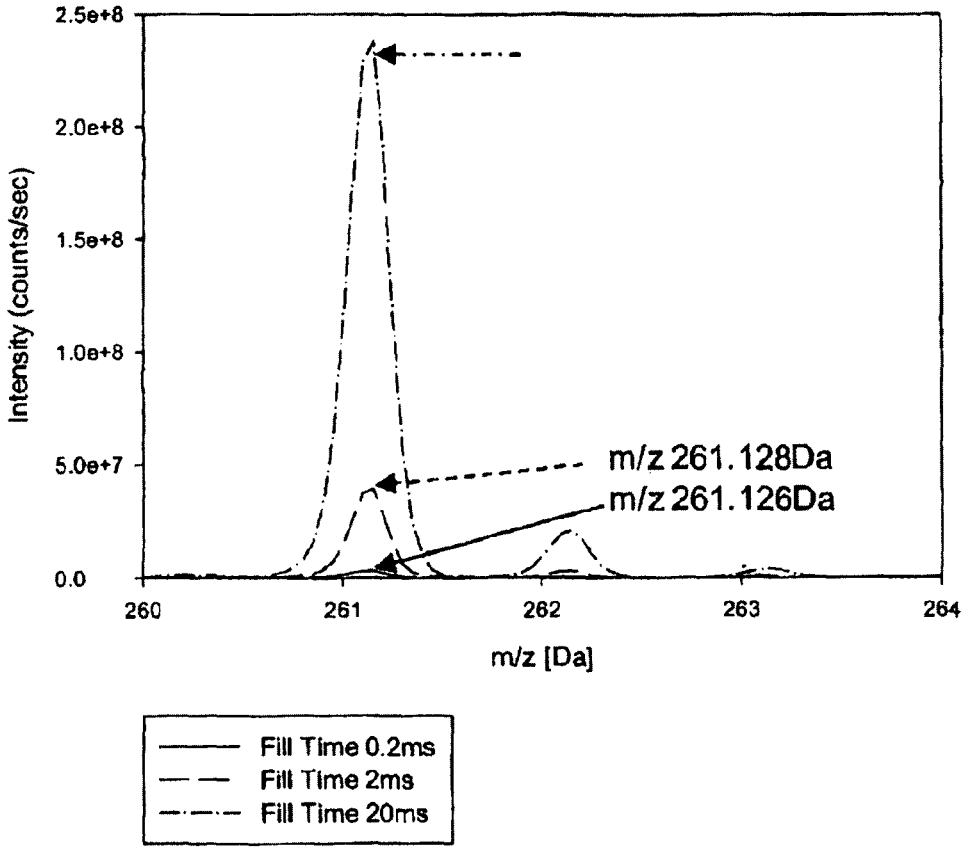
FIG. 6*b* illustrates overlapped mass spectra for different fill times zoomed around a mass of 261 Daltons taken from the full mass spectra of FIG. 6*a*, when the linear ion trap mass spectrometer system of FIG. 1 is operated in accordance with the first configuration of FIG. 2.

Referring to FIG. 6*b*, overlapped mass spectra are shown for different fill times zoomed around a mass of 261 Daltons from the full mass spectra of FIG. 4*a*. According to the first configuration of FIG. 2, the additional voltage is applied to only two of the four auxiliary electrodes. These two auxiliary electrodes, labeled auxiliary electrodes 12*a*, are disposed on different sides of the excitation plane (axis) X, next to one of the excitation rods (the excitation rod 26 shown in FIG. 2). As shown, the mass shift is very small. That is, even with the fill time of 20 ms, 100 times greater than a ms, the m/z actually measured increased by only 0.004 Daltons Daltons versus 261.126 Daltons).

Figure 6C:
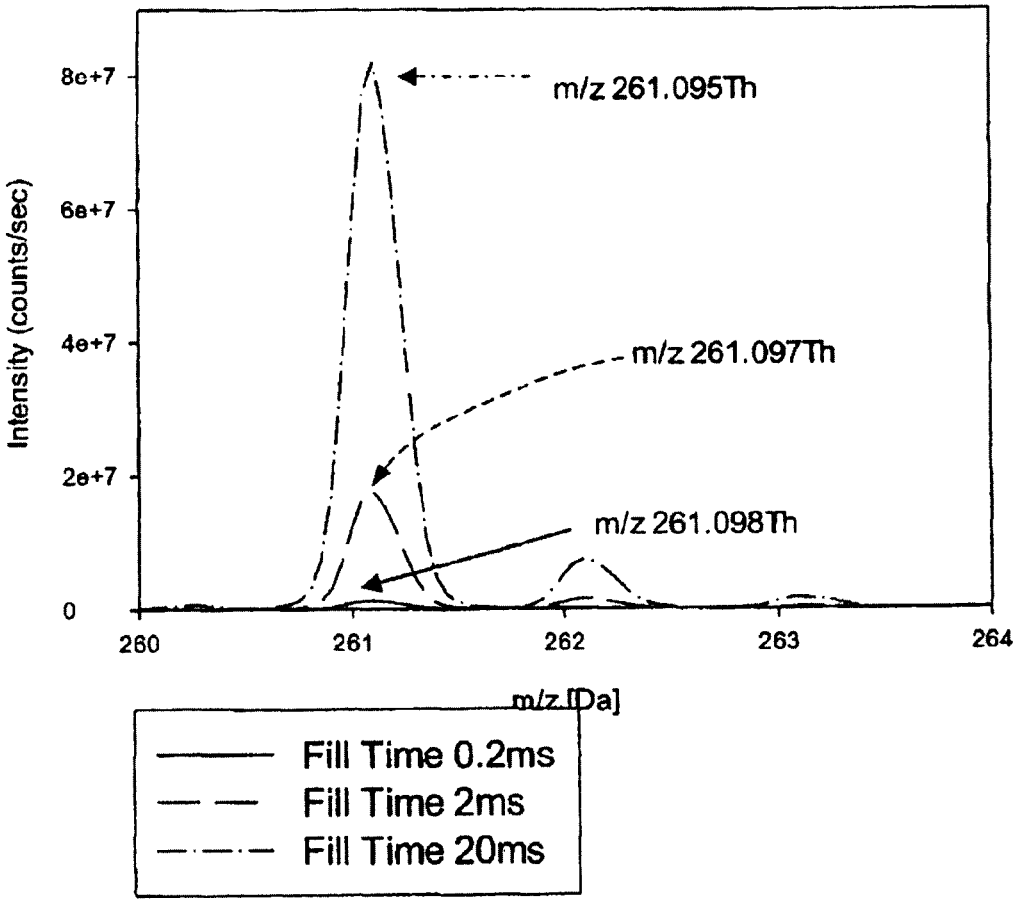
FIG. 6*c* illustrates overlapped mass spectra shown for different times zoomed around a mass of 261 Daltons taken from the full mass spectra of FIG. 6*a*, when the linear ion trap mass spectrometer system of FIG. 1 is operated in accordance with the configuration of FIG. 4.

Referring to FIG. 6*c*, overlapped mass spectra are shown for different times zoomed around a mass of approximately 261 Daltons from the full mass spectra of FIG. 6*a*. As described above, a substantially quadrupole field with significant hexapole and octapole components can also be provided in accordance with the second configuration illustrated in FIG. 4. According to this second configuration, the additional RF voltage, is again provided to the pair of auxiliary electrodes designated 12*a*; however, in this configuration both auxiliary electrodes are on the same side of the excitation plane or X axis, on either side of one of the non-excitation rods (the uppermost excitation rod 28 shown in FIG. 4). Again, as shown, the mass shift is very small. That is, even with a fill time of 20 ms, 100 greater than a fill time of 0.2 ms, the mass-to-charge ratio actually measured increased by only 0.004 Daltons (261.098 Daltons versus 261.095 Daltons). In neither the mass spectra of FIG. 6*b*, nor the mass spectra of FIG. 6*c*, has the linear ion trap been calibrated. Calibrating the linear ion trap can permit the measured mass signal peaks to be aligned with the theoretical mass of the ions to a much greater extent. However, from FIGS. 6*b* and 6*c* it is apparent that the mass signal peak illustrated in these Figures does not migrate significantly due to space charge effects.

Figure 7:
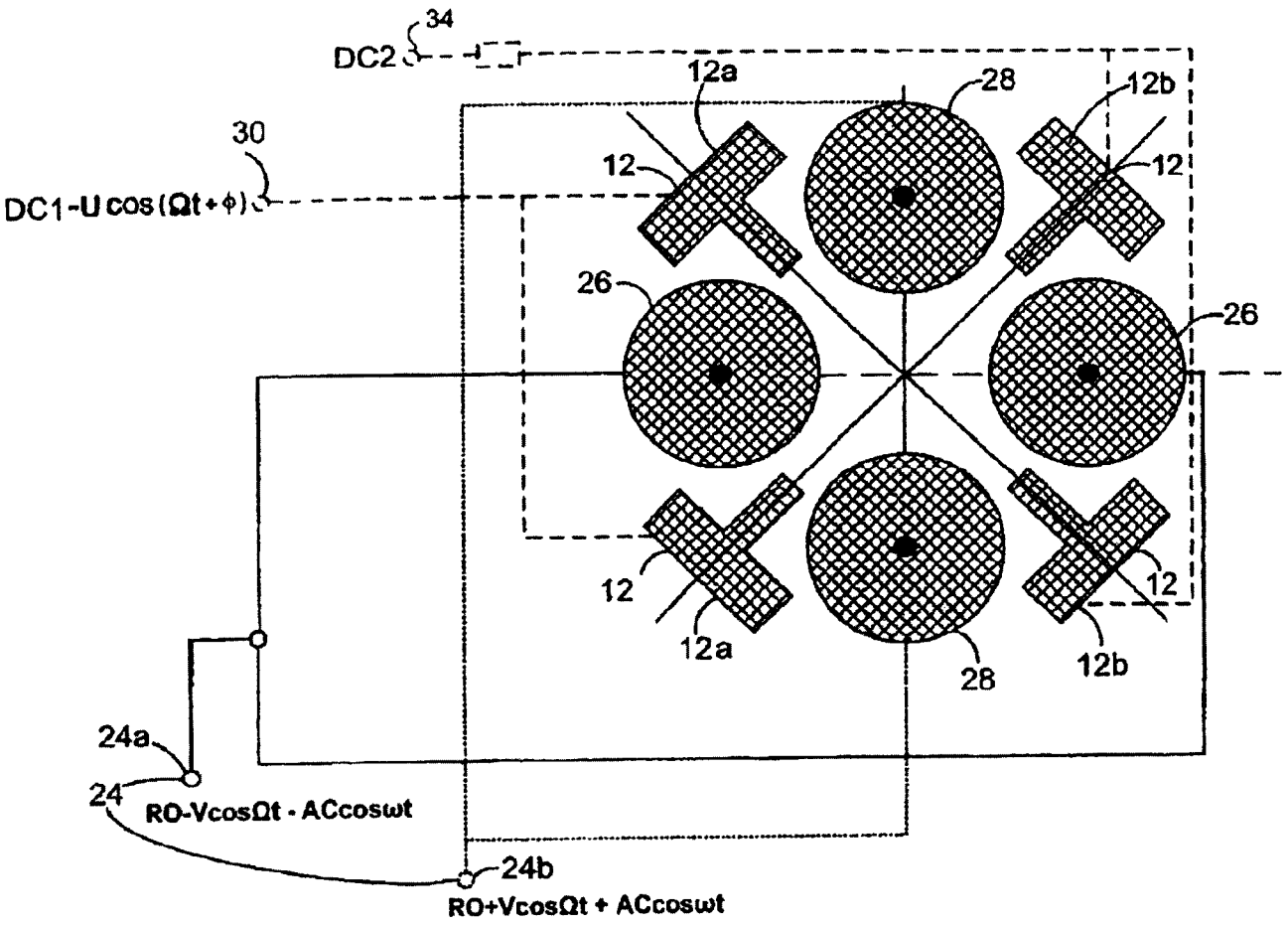
FIG. 7, in a schematic sectional view, illustrates the auxiliary electrodes and rods of a linear ion trap of a third variant of the linear ion trap mass spectrometer system of FIG. 1.

As described above, dipolar excitation may be provided to either the first pair of rods 26, or to a pair of diagonally oriented auxiliary electrodes 12. According to other embodiments of the invention, however, quadrupolar excitation can be used instead. Referring to FIG. 7, radial positions of a particular variant of the auxiliary electrodes 12 relative to linear ion trap 20 of FIG. 1 are shown. In many respects, the variant of FIG. 7 resembles the variant of FIG. 2. For clarity, the same reference numerals are used to designate like elements of the variants of FIGS. 2 and 7. For brevity, the description of FIG. 2 is not repeated in the description of FIG. 7.

Similar to the variant of FIG. 2, in the variant of FIG. 7 a main drive voltage supply 24 can supply a drive RF voltage V cos Ωt as shown. That is, similar to the variant of FIG. 2, the voltage supply 24 of FIG. 7 can include a first RF voltage source 24*a* for providing a first RF voltage, −V cos Ωt, to the first pair of rods 26 at the first frequency Ω, and in the first phase, while the voltage supply 24 can also comprise a second RF voltage source 24*b* operable to provide a second RF voltage V cos Ωt to the second pair of rods 28, again at the first frequency Ω, but opposite in phase to the first voltage applied to the first pair of rods.

Figure 8:
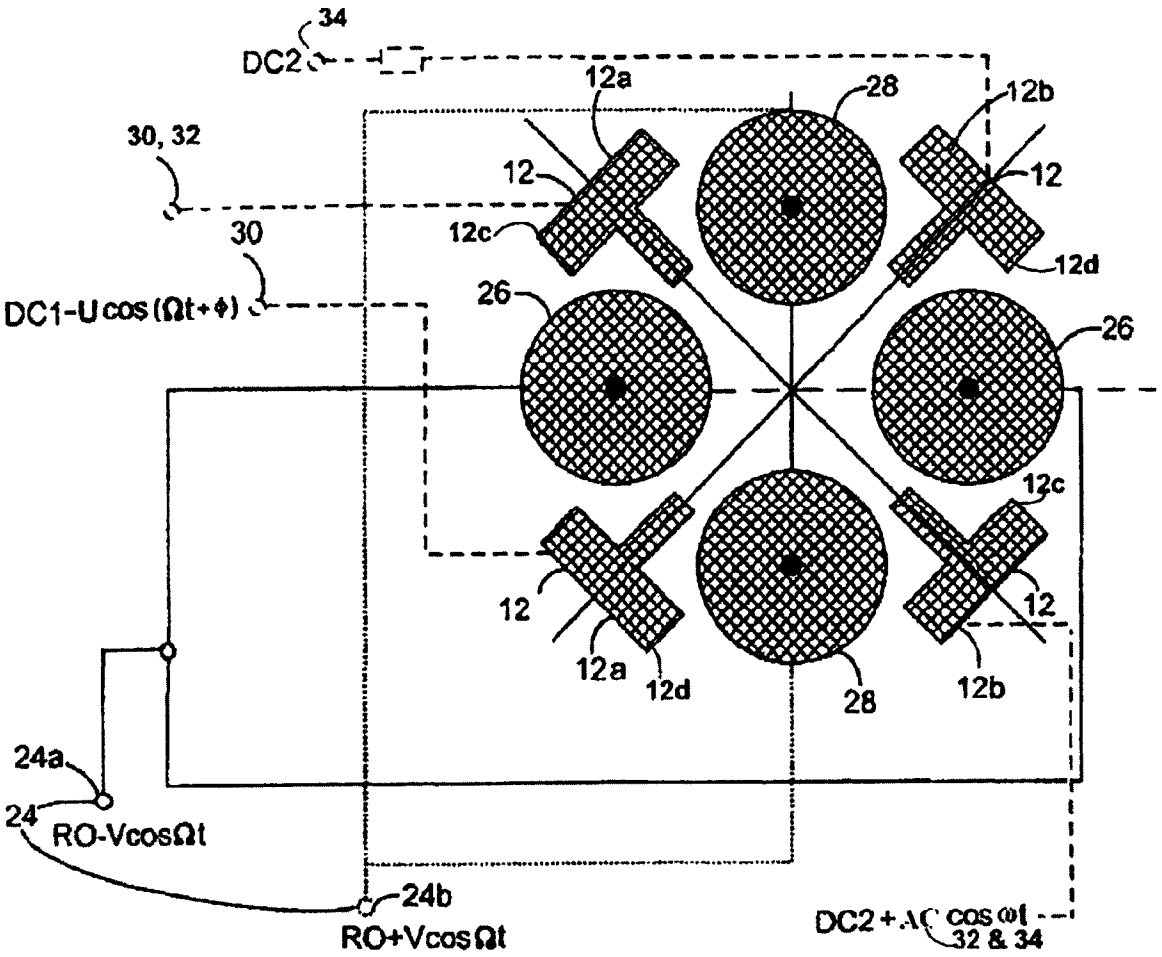
FIG. 8, in a schematic section view, illustrates the auxiliary electrodes and rods of a linear ion trap of a fourth variant of the linear ion trap mass spectrometer system of FIG. 1.

In the variant of FIG. 7, however, the first RF voltage source 24*a* can also be operable to provide a quadrupolar excitation voltage −AC cos ωt to the first pair of rods 26, while the second RF voltage source 24*b* can be operable to provide a quadrupolar excitation voltage Of course, this quadrupolar excitation voltage may not be provided all time, but can be provided to axially eject selected ions of the selected the linear ion trap 20. As described above in connection with the selected ions can be ejected past an axial lens 33 to detector shown in FIG. 1) to generate a mass spectrum. Alternatively, these ions can be transmitted to downstream rod sets for further processing. As is known in the art, the quadrupolar excitation voltage provided by the RF voltage sources can often be at a much lower frequency ω than the first frequency Referring to FIG. 8 there is illustrated in a sectional view an alternate variant of the auxiliary electrode 12 and rods 26, 28 of the linear ion trap the linear ion trap mass spectrometry system 10 of FIG. 1. Again, the variant of FIG. 8 is similar to the variant of FIG. 2, except that instead of dipolar excitation being applied to the first pair of rods 26, dipolar excitation can be provided to a diagonally oriented pair of auxiliary electrodes, designated 12*c* in FIG. 8. For clarity, the same reference numerals are used to designate analogous elements of the variants of FIGS. 2 and 8. For brevity, the description of FIG. 2 is not repeated with respect to FIG. 8. As shown in FIG. 8, a dipolar excitation AC voltage can be provided by an auxiliary AC voltage source 32 to a diagonally oriented pair of auxiliary electrodes 12*c* to provide a dipolar excitation signal to provide axial ejection as described, for example, in U.S. Pat. No. 7,692,143, the contents of which are incorporated herein by reference. As a result of the connection of the voltage sources 30 and 32 to the auxiliary electrodes 12, one auxiliary electrode 12, designated using both reference numerals 12*a* and 12*d*, is linked to voltage source 30 to receive only DC voltage, DC1 together with an RF voltage component $-U\cos(\Omega t+\phi)$ of the same periodicity or frequency as the RF voltage provided to the main electrodes or rods 26 or 28. As shown, the RF voltage applied to the auxiliary electrodes 12*a* has been phase shifted by ϕ relative to the voltage provided to the main electrodes 26 and 28.

A second auxiliary electrode 12, designated using both reference numerals 12*a* and 12*c*, receives DC voltage, DC1, an RF voltage component $U\cos(\Omega t+\phi)$, and a dipolar excitation voltage −AC cos ωt. auxiliary electrode discussed above, the RF voltage U cos applied to the auxiliary electrodes 12*a*, 12*c* has been phase shifted by ϕ relative to the RF voltage provided to the main electrodes 26 and 28. The dipolar excitation voltage frequency co can be much lower than the first frequency Ω.

A third auxiliary electrode 12, designated using both reference numerals 12*b* and 12*c*, receives DC voltage, DC2, and a dipolar voltage AC cos ωt, while the fourth auxiliary electrode 12, designated using reference numerals 12*b* and 12*d*, receives only DC voltage, DC2.

Similar to the configuration of FIG. 2, in the configurations of Figures and 8, the potential on the X axis may comprise, in addition to the quadrupole component, dodecapole, decapole, octapole, hexapole and dipole components. The hexapole component $A3_x$ can be the strongest component, being at least three times stronger than the octapole component $A4_x$ and more than stronger than higher multipoles $An_y$, where n is an integer greater than 4. dipole component can be about ten times stronger than the hexapole component $A3_x$. In contrast, the potential on the Y-axis can comprise, in addition to the main quadrupole component $A2_y$ mainly an octapole component $A4_y$, every other higher order component ($A3_y$ and $An_y$, $n_y$ being an integer greater than 4) having an amplitude less than 5% of the octapole component $A4_y$.

According to an aspect of an embodiment of the present invention there is provided a linear ion trap mass spectrometer system 10 comprising a central axis, a first pair of rods 26, a second pair of rods 28, four auxiliary electrodes 12 and voltage supplies 24, 30, 32, 34. Each rod in the first pair of rods 26 and the second pair of rods 28 can be spaced from and extend along the central axis. The four auxiliary electrodes 12 can be interposed between the first pair of rods 26 and the second pair of rods 28 in an extraction region 37 defined along at least a part of a length of the first pair of rods and the second pair of rods. The four auxiliary electrodes can comprise a first pair of auxiliary electrodes 12*a* and a second pair of auxiliary electrodes 12*b*. The first pair of auxiliary electrodes 12*a* can be separated by and adjacent to a single rod in either the first pair of rods or the second pair of rods, while the second pair of auxiliary electrodes can be separated by and adjacent to the other rod paired to the rod separating the first pair of auxiliary electrodes. The voltage supplies can be connected to the first pair of rods, the second pair of rods and the four auxiliary electrodes, and can be operable to provide i) a first RF voltage to the first pair of rods at a first frequency and in a first phase, ii) a second RF voltage to the second pair of rods at a second frequency equal to the first frequency and in a second phase, opposite to the first phase, iii) an auxiliary RF voltage to the first pair of auxiliary electrodes at an auxiliary frequency equal to the first frequency and shifted from the first phase by a phase shift, iv) a first DC voltage, DC1. to the first pair of auxiliary electrodes, and v) a second DC voltage, DC2, to the second pair of auxiliary electrodes.

Optionally, the linear ion trap system 10 can comprise a detector positioned to detect ions axially ejected from the rods set and the auxiliary electrodes. Further optionally, the voltage supplies can comprise a first voltage source 24*a* operable to provide a first RF voltage to the first pair of rods, a second voltage source 24*b* operable to provide a second RF voltage to the second pair of rods, an auxiliary voltage source 30 operable to provide the auxiliary RF voltage to the first pair of auxiliary electrodes, and a phase controller (not shown) for controlling a phase and a phase shift of the auxiliary voltage provided by the auxiliary RF voltage source.

In a further embodiment, the auxiliary voltage source can be operable to provide a first auxiliary DC voltage, DC1, to the first pair of auxiliary electrodes, and the voltage supplies can further comprise a second auxiliary voltage source 34 for providing a second auxiliary DC voltage, DC2, to the second pair of auxiliary electrodes.

Optionally, the auxiliary voltage source 30 can be further operable or adjustable to change the first auxiliary DC voltage, DC1, provided to the first pair of auxiliary electrodes 12*a*, while the second auxiliary voltage source 34 can be further operable to adjust the second auxiliary DC voltage, DC2 provided to the second pair of auxiliary electrodes 12*b*. The phase controller can be further operable to adjust the phase shift of the auxiliary voltage provided by the auxiliary RF voltage source 30.

Further optionally, the voltage source 32 can be operable to provide a dipolar excitation AC voltage to either the first pair of rods 26, or a diagonally oriented pair of auxiliary electrodes 12 at a lower frequency frequency C2 to radially excite the selected portion of the ions having the selected m/z. In embodiments in which it is the diagonally oriented pair of auxiliary electrodes that is provided with the dipolar excitation DC voltage, this diagonally oriented pair of auxiliary electrodes can comprise one electrode each of the first pair of auxiliary electrodes 12*a* and the second pair of auxiliary electrodes 12*b*.

In some embodiments, the linear ion trap 20 is configured such that at any point along the central axis, an associated plane orthogonal to the central axis intersects the central axis, intersects the first pair of rods at an associated first pair of cross section, and intersects the second pair of rods at an associated second pair of cross sections. For example, in the sectional view of FIG. 2, the associated plane defines the sectional view, such that the first pair of rods 26 are represented by the first pair of cross section 26, while the second pair of rods 28 are represented by the second pair of cross sections 28. The associated first pair of cross section 26 are substantially symmetrically distributed about the central axis and are bisected by a first axis lying in the associated plane orthogonal to the central axis and passing through a center of each cross section in the first pair of cross sections. In the variant of FIG. 2, the first axis is the X axis. The associated second pair cross sections 28 are substantially symmetrically distributed about the central axis and are bisected by a second axis lying in the associated plane orthogonal to the central axis and passing through a center of each cross section in the second pair of cross sections. In the variant of FIG. 2, the second axis is the Y axis, and the central axis, shown as a point in FIG. 2, lies at the intersection of the X and Y axes. At any point along the central axis in an extraction portion of the central axis lying within the extraction region 37, the associated plane orthogonal to the central axis intersects the first pair of auxiliary electrodes 12*a* at an associated first pair of auxiliary cross sections, and intersects the second pair of auxiliary electrodes 12*b* at an associated second pair of auxiliary cross sections. In FIG. 2, the first pair of auxiliary electrodes are represented by the first pair of auxiliary cross section 12*a*, while the second pair of auxiliary electrodes are represented by the second pair of auxiliary cross sections 12*b*.

In many embodiments, the extraction portion of the central axis comprises less than half a length of the central axis.

Optionally, the extraction region can be an ejection end of the first pair of rods 26 and the second pair of rods 28, and the four auxiliary electrodes 12 can extend axially beyond the ejection end of the first pair of rods 26 and second pair of rods 28. Alternatively, the four auxiliary electrodes 12 can end short of the ejection end of the first pair of rods 26 and the second pair of rods 28. Optionally, each cross section in the first pair of auxiliary cross sections and the second pair of auxiliary cross sections can be substantially T-shaped, including a rectangular base section connected to a rectangular top section.

Using the linear ion trap mass spectrometer system of FIG. 1, according to either the configuration of FIG. 2 or the configurations of FIG. 3, 4 or 5, ions can be advantageously processed. For example, higher space charge densities can be accommodated without significant peak migration. According to the method in accordance with an aspect of an embodiment of an invention, a two-dimensional asymmetric substantially quadrupole field having a first axis potential along the first axis, a second axis orthogonal to the first axis and a second axis potential along the second axis can be provided. The first axial potential can comprise a quadrupole harmonic of amplitude $A2_1$, a hexapole harmonic of amplitude $A3_1$ and an octapole harmonic of amplitude $A4_1$ wherein in various embodiments $A4_1$ is greater than 0.001% of $A2_1$, wherein in various embodiments $A4_1$ is greater than 0.01% of $A2_1$, $A4_1$ is less than 5% of $A2_1$ and 33% of $A3_1$, and for any other higher order harmonic with amplitude present in the first axis potential, and $n_1$ being any integer greater than 4, is greater than 10% $An_1$. The second axis potential can comprise a quadrupole harmonic amplitude $A2_2$ and an octapole harmonic of amplitude $A4_2$, wherein in various embodiments $A4_2$ is greater than 0.001% of $A2_2$, wherein in various embodiments $A4_2$ is greater than 0.01% of $A2_2$, $A4_2$ is less than 5% of $A2_2$ and, for any other higher order harmonic with amplitude $An_2$ present in the second axis potential of the field, $n_2$ being any integer greater than 2 except 4, $A4_2$ is greater than 10% $An_2$. Once this field has been established and generated and while it is being maintained, ions can be introduced to the field.

According to the first configuration shown in FIG. 2, the first axis could be the X axis, and the second axis the Y axis, such that the first axis potential is the X axis potential and the second axis potential is the Y axis potential.

On the other hand, in the case of the second configuration of FIG. 3, the first axis can be the Y axis and the second axis can be the X axis, the larger hexapole component is provided on the Y axis and not the X axis.

Optionally, $A3_1$ can be greater than 30, or even 50 times $An_1$.

Optionally, the linear ion trap 20 comprises a first pair of rods 26, a second pair of rods 28 and four auxiliary electrodes 12 interposed between the first pair of rods 26 and the second pair of rods 28 and comprising a first pair of auxiliary electrodes 12 and a second pair of auxiliary electrodes 12 separated by a first plane bisecting one of the first pair of rods 26 and the second pair of rods 28. Relating this embodiment to the above-described embodiments, 1) the first axis lies in the first plane and the second axis is orthogonal to the first plane, and 2) establishing and maintaining the field comprises providing i) a first RF voltage to the first pair of rods 26 at a first frequency and in a first phase, ii) a second RF voltage to the second pair of rods 28 at a second frequency equal to the first frequency and in a second phase, opposite to the first phase, and iii) an auxiliary RF voltage to the first pair of auxiliary electrodes at an auxiliary frequency equal to the first frequency and shifted from the first phase by a phase shift, iv) a first DC voltage to the first pair of auxiliary electrodes, and v) a second DC voltage to the second pair of auxiliary electrodes. The method may comprise: 1) axially transmitting, that is axially ejecting as known in the art, a selected portion of the ions from the field, the selected portion of the ions having a selected m/z; 2) detecting the selected portion of the ions to provide a sliding mass signal peak centered about a sliding m/z ratio and 3) adjusting at least one of i) the phase shift the auxiliary RF voltage; ii) voltage the first pair of auxiliary electrodes, iii) the second DC voltage provided to the second pair of auxiliary electrodes, and iv) the auxiliary RF voltage provided to the first pair of auxiliary electrodes to slide the sliding m/z ratio toward the selected m/z.

Optionally, establishing and maintaining the field can comprise providing a second DC voltage DC2 to the second pair of auxiliary electrodes without providing an RF voltage to the second pair of auxiliary electrodes 12*b*.

Further optionally, establishing and maintaining the field can comprise providing a second auxiliary RF voltage to the second pair of auxiliary electrodes 12*b* with the second DC voltage DC2, wherein the second auxiliary RF voltage is 180° phase shifted relative to the auxiliary RF voltage provided to the first pair of auxiliary electrodes.

Optionally, the phase shift of the auxiliary RF voltage can be changed by a phase controller, such as, for example, a phase variable all-pass filter coupled to a downstream RF amplifier to slide the sliding m/z ratio toward the selected m/z. The actual phase shift relative to the first phase can be zero. The sliding m/z ratio is termed such as this m/z ratio can be moved along the horizontal of the mass spectrum by adjusting variables such as the phase shift of the auxiliary RF voltage, the first DC voltage provided to the first pair of auxiliary electrodes, the second DC voltage provided to the second pair of auxiliary electrodes, and the auxiliary RF voltage provided to the first pair of auxiliary electrodes.

Optionally, the phase shift can be between 50° and 70°, between and 61°, or between −70° and 70°. According to further embodiments, the desired phase shift can also depend on an of the RF voltages provided to the first pair of rods 26 and the second pair of rods 28. As described above, this phase shift can also be adjusted from the optimal phase between 50° and 70° or optionally between −70° and 70° to achieve better peak resolution at the cost of reduced sensitivity. That is, at a higher phase shift, the amplitude of the RF of the auxiliary electrodes can be increased without a loss mass accuracy. Additionally, the balance of the RF applied to the main rods 26, 28 of the linear ion trap 20, can also play a role in defining the range of the optimal phase shift, and the RF amplitude on the auxiliary electrodes 12 required to achieve a specific mass resolution and sensitivity. In other words, while in the variants shown in FIGS. 2 and 3, the magnitude of the RF provided to both pairs of rods 26 and 28 remains the same, optionally, a different magnitude of RF could be provided to the rods 26 relative to the magnitude of the RF provided to the rods 28.

The potential of a linear quadrupole with an added hexapole octopole, and no other multipoles is given by equation (1) and (2). See, for example Douglas et al., Russian Journal of The Technical Physics, 1999, vol. 69, 96-101. When a dipole moment is also present on one of the axes, the X axis for the variant of FIG. 2, an additional $\Phi_1(x)=A_1x/r_0$ would contribute to the field, where $r_0$ is the field radius. Equation 2 (and 3) below show the potential on the X-axis when dipole, hexapole and octopole fields are added to the field. In the equations that follow, terms that include y are null, as Y=0 on the X axis.

$$\Phi(x, y) = \Phi_0(x, y) + \Phi_2(x, y) + \Phi_3(x, y) + \Phi_4(x, y) \quad (1)$$

$$\Phi_0(x, y) = A_0 \quad \text{Constant Potential}$$

$$\Phi_2(x, y) = A_2\left(\frac{x^2 - y^2}{r_0^2}\right) \quad \text{Quadrupole potential}$$

$$\Phi_3(x, y) = A_3\left(\frac{x^3 - 3xy^2}{r_0^3}\right) \quad \text{Hexapole Potential}$$

$$\Phi_4(x, y) = A_4\left(\frac{x^4 - 6x^2y^2 + y^4}{r_0^4}\right) \quad \text{Octapole Potential}$$

$$\Phi(x, y) = \Phi_0(x) + \Phi_1(x) + \Phi_2(x) + \Phi_3(x) + \Phi_4(x) \quad (2)$$

$$\Phi(x) = A_0 + A_1\left(\frac{x}{r_0}\right) + A_2\left(\frac{x^2}{r_0^2}\right) + A_3\left(\frac{x^3}{r_0^3}\right) + A_4\left(\frac{x^4}{r_0^4}\right) \quad (3)$$

According to variants of embodiments of the present invention, the generated can be considered a two-dimensional asymmetric substantially quadrupole field comprising a central axis, wherein the first axis and the second axis (being the X axis and the Y axis, not necessarily respectively) described above in connection with other variants of the invention, intersect at the central axis. As described above, the first axis bisects the cross-sections of one pair of rods, while the second axis bisects the cross-sections of another pair of rods. In this two dimensional field, a sum obtained by adding the absolute value of the octapole component $\Phi_4$ and the absolute value of the hexapole component $\Phi_3$ along the first axis can increase moving from the cross-sections bisected by the first axis to the central axis. Similarly, also in this two-dimensional field, a second sum obtained by adding the absolute value of the octapole component $\Phi_4$ along the second axis, and the absolute value of the hexapole component $\Phi_3$ along the second axis can increase moving from the pair of rods bisected by the second axis toward the central axis.

According to further embodiments, the linear ion trap 20 of linear trap system 10 of FIG. 1 can comprise an axial lens 33 and the four auxiliary electrodes 12 can be interposed between the first pair of rods 26 and the second pair of rods 28 in an extraction region defined along at least a part of the length of the four rods 26 and 28. In such a variant, a method in accordance with an aspect of an embodiment of the present invention can further comprise axially trapping a selected portion of the ions in the extraction region 37 before axially transmitting, that is axially ejecting, the selected portion of the ions.

In a further variant of this embodiment of the present invention, axially trapping the selected portion of the ions in the extraction region before axially transmitting, that is axially ejecting the selected portion of the ions may comprise providing a rod offset voltage RO to the first pair of rods and the second pair of rods. The rod offset voltage RO can be higher than the DC voltage provided to the four auxiliary electrodes. A DC trapping voltage can also be provided to the axial lens 33, and the rod offset voltage can be lower than this axial lens voltage. By this means, a voltage well can be created in the vicinity of the auxiliary electrodes 12 to hold the selected portion of the ions prior to their axial ejection.

As described above, transmitting, that is axially ejecting the selected portion of the ions m/z from the field can comprise providing a AC voltage to either the first pair of rods or a diagonally oriented pair of auxiliary electrodes at a lower frequency than the first frequency to radially excite the selected portion of the ions having the selected m/z. As shown in FIG. 8, the diagonally oriented pair of auxiliary electrodes are separated by plane bisecting one of the first pair of rods and the second pair of rods, and a second plane orthogonal to the first plane and bisecting the other of the first pair rods and the second pair of rods. In the variant of FIG. 8, the diagonally oriented pair of rods to which the dipolar excitation AC voltage is applied are the rods 12*c*; alternatively, however, the dipolar excitation voltage might just as easily have been applied to the diagonally oriented pair of rods 12*d*.

Optionally, as described above, axially transmitting, that is axially ejecting the selected portion of the ions having the selected m/z comprise providing a quadrupole excitation voltage to rods and the second pair of rods at a lower frequency than the first frequency to radially excite the selected portion of the ions having the selected According to further variants of embodiments of the present invention, the auxiliary electrodes 12 and main rods 26, 28, can be recalibrated after ejection of a selected portion of the ions to eject subsequent portions of the ions having different m/z. For example, different settings for either the phase auxiliary frequency of the auxiliary RF voltage or the first DC voltage provided to the first pair of auxiliary electrodes, or the second DC voltage provided to the second pair of auxiliary electrodes, or the auxiliary RF voltage provided to the first pair of auxiliary electrodes, may be desirable to slide the toward the selected m/z for different ions of different m/z. Thus, according to some embodiments of the present invention, after axially transmitting, that is axially ejecting the selected portion of the ions having a field, the method can further comprise 1) axially transmitting, that is axially ejecting a second selected portion of the ions from the field, the second selected portion of the ions having a selected m/z; 2) detecting a second selected portion of the ions to provide a second sliding mass signal peak centered about a second sliding m/z ratio, and 3) adjusting at least one of i) the phase shift of the auxiliary frequency of the auxiliary RF voltage; ii) the first DC voltage provided to the first pair of auxiliary electrodes; voltage provided to the second pair of auxiliary electrode; and iv) the auxiliary RF voltage provided to the first pair of auxiliary electrodes to slide the sliding m/z ratio toward the selected m/z.

Optionally, the phase shift may be adjusted based on changes to one or more of the following variables: i) a magnitude of the first RF voltage; i) a magnitude of the second RF voltage; and, iii) the first frequency voltage (which is also the second frequency of the second RF voltage).

In use, in accordance with an aspect of an embodiment of the present invention, there is provided a method of processing ions in a method establishing and maintaining a two-dimensional asymmetric substantially quadrupole field having a first axis, a first axis potential along the first axis, a second axis orthogonal to the first axis and a second axis potential along the second axis, and then introducing ions to the field. The first axis potential comprises a quadrupole harmonic of amplitude $A2_1$, a hexapole harmonic of amplitude $A3_1$ and an octapole harmonic of amplitude $A4_1$, wherein in various embodiments, $A4_1$ is greater than embodiments wherein $A4_1$ is greater than $A2_1$ and 33% of $A3_1$, and for any other higher order harmonic with amplitude present in the first axis potential, $n_1$ being any integer greater greater than ten times $An_1$. The second axis potential comprises a quadrupole harmonic of amplitude $A2_2$, and an octapole harmonic of amplitude $A4_2$, wherein in various embodiments $A4_2$ is greater than 0.001% of $A2_2$, and wherein in various embodiments $A4_2$ is greater than 0.01% of $A2_2$, $A4_2$ is less than 5% of $A2_2$ and, for any other higher order harmonic with amplitude $An_2$ present in the second axis potential of the field, $n_2$ being any integer greater than 2 except 4, $A4_2$ is greater than ten times $An_2$.

In accordance with an aspect of an embodiment of the present invention, $A3_1$ is greater than thirty times $An_1$. In accordance with an aspect of an embodiment of the present invention, $A3_1$ is greater than fifty times $An_1$.

In accordance with an aspect of an embodiment of the present invention, a method is provided wherein the linear ion trap comprises a first pair second pair of rods and four auxiliary electrodes interposed between the first pair of rods and the second pair of rods and comprising a first pair of auxiliary electrodes and a second pair of auxiliary electrodes separated by a first plane bisecting one of the first pair of rods and the second pair of rods. The first axis lies in the first plane and the second axis is orthogonal to the first plane. Establishing and maintaining the field can comprise providing a first RF voltage to the first pair of rods at a first frequency and in a first phase, a second RF voltage to the second pair of rods at a second frequency equal to the first frequency and in a second phase, opposite to the first phase, and an auxiliary RF voltage to the first pair of auxiliary electrodes at an auxiliary frequency equal to the first frequency and shifted from the first phase by a phase shift, a first DC voltage to the first pair of auxiliary electrodes, and a second DC voltage to the second pair of auxiliary electrodes. The method further comprises axially ejecting a selected portion of the ions from the field, the selected portion of the ions having a selected m/z, detecting the selected portion of the ions to provide a sliding mass signal peak centred about a sliding m/z ratio and adjusting at least one of the phase shift of the auxiliary RF voltage, the first DC voltage provided to the first pair of auxiliary electrodes, the second DC voltage provided to the second pair of auxiliary electrodes, and the auxiliary RF voltage provided to the first pair of auxiliary electrodes to selected m/z.

In accordance with an aspect of an embodiment of the present invention, a method is provided wherein the a first pair of rods, a second pair of rods and two auxiliary electrodes interposed between one of the first pair of rods and one of the second pair of rods and comprising a pair of auxiliary electrodes separated by a first plane bisecting either one of the first pair of rods or one of the second pair of rods. The first axis lies in the first plane and the second axis is orthogonal to the first plane. Establishing and maintaining the field can comprise providing a first RF voltage to the first pair of rods frequency and in a first phase, a second RF voltage to the second pair of rods at a second frequency equal to the first frequency and in a second phase, opposite to the first phase, and an auxiliary RF voltage to the pair of auxiliary electrodes at an auxiliary frequency equal to the first frequency and shifted from the first phase by a phase shift, and a DC voltage to the pair of auxiliary electrodes. The method further comprises axially ejecting a selected portion of the ions from the field, the selected portion of the ions having a selected m/z, detecting the selected portion of the ions to provide a sliding mass signal peak centred about a sliding m/z ratio and adjusting at least one of the phase shift of the auxiliary RF voltage, the DC voltage provided to the pair of auxiliary electrodes, and the auxiliary RF voltage provided to the pair of auxiliary electrodes to slide the sliding m/z ratio toward the selected m/z.

In various embodiments, the asymmetric substantially quadrupole field generated comprises an X axis (e.g., the first axis), separating one auxiliary electrode from the other electrode. In various embodiments, the asymmetric substantially quadrupole field generated comprises a Y axis (e.g., the second axis), separating one auxiliary electrode from the other electrode.

In various embodiments, establishing and maintaining the field comprises providing the DC voltage to the second pair of auxiliary electrodes without providing an RF voltage to the second pair of auxiliary electrodes.

In various embodiments, the method establishing and maintaining the field comprises providing the DC voltage to the pair of auxiliary electrodes.

In various embodiments, establishing and maintaining the field comprises providing a second auxiliary RF voltage to the second pair of auxiliary electrodes with the DC voltage wherein the second auxiliary RF voltage is 180 degrees phase shifted relative to the auxiliary RF voltage provided to the first pair of auxiliary electrodes.

In various embodiments, establishing and maintaining the field comprises providing a second auxiliary RF voltage to the pair of auxiliary electrodes with the DC voltage wherein the second auxiliary RF voltage is 180 degrees phase shifted relative to the auxiliary RF voltage provided to the pair of auxiliary electrodes.

In various embodiments, the method further comprises adjusting the phase shift of the auxiliary RF voltage to slide the sliding m/z ratio toward the selected m/z.

In various embodiments, the method further comprises adjusting at least one of the first DC voltage provided to the first pair of auxiliary electrodes, and the second DC voltage provided to the second pair of auxiliary electrodes to slide the sliding m/z ratio toward the selected m/z. In various embodiments, the phase shift is between −70 degrees and 70 degrees. In various embodiments, the phase shift is zero degrees.

In various embodiments, the method further comprises adjusting the DC voltage provided to the pair of auxiliary electrodes, to slide the sliding m/z ratio toward the selected m/z. In various embodiments, the phase shift is between −70 degrees and 70 degrees. In various embodiments, the phase shift is zero degrees.

In various embodiments, axially ejecting the selected portion of the ions having the selected m/z from the field comprises providing a quadrupole excitation AC voltage to the first pair of rods and the second pair of rods at a lower frequency than the first frequency to radially excite the selected portion of the ions having the selected m/z.

In various embodiments, a method is provided wherein the linear ion trap further comprises an exit lens, and the four auxiliary electrodes are interposed between the first pair of rods and the second pair of rods in an extraction region defined along at least part of a length of the four rods, the method further comprising axially trapping the selected portion of the ions in the extraction region before axially ejecting the selected portion of the ions.

In various embodiments, the method is provided wherein the linear ion trap further comprises an exit lens, and the pair of auxiliary electrodes are interposed between one of the first pair of rods and one of the second pair of rods in an extraction region defined along at least part of a length of the four rods. The method can further comprise axially trapping the selected portion of the ions in the extraction region before axially ejecting the selected portion of the ions.

In various embodiments, axially trapping the selected portion of the ions in the extraction region before axially ejecting the selected portion of the ions comprises providing a rod offset voltage to the first pair of rods and the second pair of rods, the rod offset voltage can be higher than the DC voltage(s) provided to the auxiliary electrodes, and, providing a DC trapping voltage applied to the exit lens, wherein the rod offset voltage is lower than the DC trapping voltage applied to the exit lens.

In various embodiments, axially ejecting the selected portion of the ions having the selected m/z from the field, comprises providing a dipolar excitation AC voltage to either the first pair of rods or a diagonally oriented pair of auxiliary electrodes at a lower frequency than the first frequency to radially excite the selected portion of the ions having the selected m/z, wherein the diagonally oriented pair of auxiliary electrodes are separated by both the first plane bisecting one of the first pair of rods and the second pair of rods, and a second plane orthogonal to the first plane and bisecting the other of the first pair of rods and the second pair of rods.

In various embodiments, the method further comprises, after axially ejecting the selected portion of the ions having the selected m/z from the field, axially ejecting a second selected portion of the ions from the field, the second selected portion of the ions having a second selected m/z, detecting a second selected portion of the ions to provide a second sliding mass signal peak centered about a second sliding m/z ratio and adjusting at least one of the phase shift of the auxiliary frequency of the auxiliary RF voltage, the first DC voltage provided to the first pair of auxiliary electrodes, the second DC voltage provided to second pair of auxiliary electrodes, and the auxiliary RF voltage provided to the first pair of auxiliary electrodes to slide the sliding m/z ratio toward the selected m/z.

In various embodiments, the method further comprises, after axially ejecting the selected portion of the ions having the selected m/z from the field, axially ejecting a second selected portion of the ions from the field, the second selected portion of the ions having a second selected m/z, detecting a second selected portion of the ions to provide a second sliding mass signal peak centered about a second sliding m/z ratio, and adjusting at least one of the phase shift of the auxiliary RF voltage or the DC voltage provided to the pair of auxiliary electrodes, or the auxiliary RF voltage provided to the pair of auxiliary electrodes; to slide the sliding m/z ratio toward the selected m/z.

In various embodiments, adjusting the phase shift to slide the sliding m/z ratio toward the selected m/z comprises adjusting the phase shift based on changes to at least one of a magnitude of the first RF voltage, a magnitude of the second RF voltage, and the first frequency, wherein the second frequency changes with the first frequency.

In use, in accordance with another aspect of an embodiment of the present invention, there is provided a linear ion trap system comprising a central axis, a first pair of rods, wherein each rod in the first pair of rods is spaced from and extends alongside the central axis, a second pair of rods, wherein each rod in the second pair of rods is spaced from and extends alongside the central axis, four auxiliary electrodes interposed between the first pair of rods and the second pair of rods in an extraction region defined along at least part of a length of the first pair of rods and the second pair of rods, and voltage supplies connected to the first pair of rods, the second pair of rods and the four auxiliary electrodes. The four auxiliary electrodes comprise a first pair of auxiliary electrodes and a second pair of auxiliary electrodes, and the first pair of auxiliary electrodes are separated by, and are adjacent to, a single rod in either the first pair of rods or the second pair of rods. The voltage supplies are operable to provide a first RF voltage to the first pair of rods at a first frequency and in a first phase, a second RF voltage to the second pair of rods at a second frequency equal to the first frequency and in a second phase, opposite to the first phase, an auxiliary RF voltage to the first pair of auxiliary electrodes at an auxiliary frequency equal to the first frequency and shifted from the first phase by a phase shift, a first DC voltage to the first pair of auxiliary electrodes, and a second DC voltage to the second pair of auxiliary electrodes. In various embodiments, the RF applied on the auxiliary electrodes is phase locked to the RF applied to the first pair of rods, and the phase shift relative to the first phase of the RF applied to the first pair of rods can be zero degrees or between −70 and 70 degrees.

In accordance with an aspect of an embodiment of the present invention, there is provided a linear ion trap system comprising a central axis, a first pair of rods, wherein each rod in the first pair of rods is spaced from and extends alongside the central axis, a second pair of rods, wherein each rod in the second pair of rods is spaced from and extends alongside the central axis, two auxiliary electrodes interposed between one of the first pair of rods and one of the second pair of rods in an extraction region defined along at least part of a length of the first pair of rods and the second pair of rods, wherein the two auxiliary electrodes comprise a pair of auxiliary electrodes, the pair of auxiliary electrodes being separated by and adjacent to a single rod from the first pair of rods and a single rod from the second pair of rods. A voltage supply is connected to the first pair of rods, the second pair of rods and the two auxiliary electrodes, the voltage supply being operable to provide a first RF voltage to the first pair of rods at a first frequency and in a first phase, a second RF voltage to the second pair of rods at a second frequency equal to the first frequency and in a second phase, opposite to the first phase, an auxiliary RF voltage to the pair of auxiliary electrodes at an auxiliary frequency equal to the first frequency and shifted from the first phase by a phase shift, and a DC voltage to the first pair of auxiliary electrodes. In various embodiments, the RF applied on the auxiliary electrodes is phase locked to the RF applied to the first pair of rods, and the phase shift relative to the first phase of the RF applied to the first pair of rods can be zero degrees or between −70 and 70 degrees.

In various embodiments, the asymmetric substantially quadrupole field generated comprises an X axis, separating one auxiliary electrode from the other electrode.

In various embodiments, the asymmetric substantially quadrupole field generated comprises a Y axis, separating one auxiliary electrode from the other electrode.

In various embodiments, the linear ion trap system further comprises a detector positioned to detect ions axially ejected from the rod set and the auxiliary electrodes.

In various embodiments, the voltage supply comprises a first voltage source operable to provide the first RF voltage to the first pair of rods, a second voltage source operable to provide the second RF voltage to the second pair of rods, an auxiliary voltage source operable to provide the auxiliary RF voltage to the first pair of auxiliary electrodes, or in various embodiments to the pair of auxiliary electrodes, and a phase controller for controlling a phase and a phase shift of the auxiliary voltage provided by the auxiliary RF voltage source.

In various embodiments, the auxiliary voltage source is further operable to provide a first auxiliary DC voltage to the first pair of auxiliary electrodes, and the voltage supply further comprises a second auxiliary voltage source for providing a second auxiliary DC voltage to the second pair of auxiliary electrodes.

In various embodiments, auxiliary voltage source is further operable to adjust the first auxiliary DC voltage provided to the first pair of auxiliary electrodes and the second auxiliary voltage source is further operable to adjust the second auxiliary DC voltage provided to the second pair of auxiliary electrodes.

In various embodiments, the auxiliary voltage source is further operable to adjust the first auxiliary DC voltage provided to the pair of auxiliary electrodes. In various embodiments, the auxiliary voltage source is further operable to adjust the auxiliary DC voltage provided to the pair of auxiliary electrodes.

In various embodiments, the phase controller is further operable to adjust the phase shift of the auxiliary voltage provided by the auxiliary RF voltage source.

In various embodiments, the voltage supply is further operable to provide a dipolar excitation AC voltage to either the first pair of rods or a diagonally oriented pair of auxiliary electrodes at a lower frequency than the first frequency to radially excite the selected portion of the ions having the selected m/z. For example, the diagonally oriented pair of auxiliary electrodes comprise one electrode from each of the first pair of auxiliary electrodes and the second pair of auxiliary electrodes.

In various embodiments, at any point along the central axis, an associated plane orthogonal to the central axis intersects the central axis, intersects the first pair of rods at an associated first pair of cross sections, and intersects the second pair of rods at an associated second pair of cross sections. The associated first pair of cross sections are substantially symmetrically distributed about the central axis and are bisected by a first axis lying in the associated plane orthogonal to the central axis and passing through a center of each cross section in the first pair of cross sections. The associated second pair of cross sections are substantially symmetrically distributed about the central axis and are bisected by a second axis lying in the associated plane orthogonal to the central axis and passing through a center of each cross section in the second pair of cross sections. The first axis and the second axis are substantially orthogonal and intersect at the central axis. At any point along the central axis in an extraction portion of the central axis extraction region, the associated plane orthogonal to the central axis intersects the first pair of auxiliary electrodes at a first pair of auxiliary cross sections and intersects the second pair of auxiliary electrodes at an associated second pair of auxiliary cross sections.

In various embodiments, the extraction portion of the central axis comprises less than half a length of the central axis.

In various embodiments, the extraction region comprises an ejection end of the first pair of rods and the second pair of rods, and wherein the four auxiliary electrodes extend axially beyond the ejection end of the first pair of rods and the second pair of rods.

In various embodiments, the extraction region comprises an ejection end of the first pair of rods and the second pair of rods, and wherein auxiliary electrodes extend axially beyond the ejection end of the first pair of rods and the second pair of rods.

In various embodiments, the extraction region comprises an ejection end of the first pair of rods and the second pair of rods, and auxiliary electrodes end short of the ejection end of the first pair of rods and the second pair of rods.

In various embodiments, the extraction region comprises of the first pair of rods and the second pair of rods, and wherein the pair of auxiliary electrodes end short of the ejection end of the first pair of rods and the second pair of rods.

In various embodiments, each cross section in the first pair of auxiliary cross sections and the second pair of auxiliary cross sections are substantially T-shaped, comprising a rectangular base section connected to a rectangular top section. In various embodiments, each cross section in the pair of auxiliary cross sections are substantially shaped, comprising a rectangular base section connected to a rectangular top section.

All such modifications or variations are believed to be within the sphere and scope of the applicant's teachings as defined by the claims appended hereto.

The invention claimed is:

1. A method of processing ions in a linear ion trap, the method comprising:

establishing and maintaining a two-dimensional asymmetric substantially quadrupole field having a first axis, a first axis potential along the first axis, a second axis orthogonal to the first axis and a second axis potential along the second axis, wherein i) the first axis potential comprises a quadrupole harmonic of amplitude $A2_1$, a hexapole harmonic of amplitude $A3_1$ and an octapole harmonic of amplitude $A4_1$, $A4_1$ is greater than 0.01% of $A2_1$, $A4_1$ is less than 5% of $A2_1$ and 33% of $A3_1$, and for any other higher order harmonic with amplitude $An_1$ present in the first axis potential, $n_1$ being any integer greater than 4, $A3_1$ is greater than ten times $An_1$; and, ii) the second axis potential comprises a quadrupole harmonic of amplitude $A2_2$, and an octapole harmonic of amplitude $A4_2$, wherein $A4_2$ is greater than 0.01% of $A2_2$, $A4_2$ is less than 5% of $A2_2$ and, for any other higher order harmonic with amplitude $An_2$ present in the second axis potential of the field, $n_2$ being any integer greater than 2 except 4, $A4_2$ is greater than ten times $An_2$;

introducing ions to the field.

2. The method as defined in claim 1 wherein $A4_1$ is greater than 0.001% of $A2_1$ and wherein $A4_2$ is greater than 0.001% of $A2_2$.

3. The method as defined in claim 1 wherein $A3_1$ is greater than thirty times $An_1$.

4. The method as defined in claim 1 wherein $A3_1$ is greater than fifty times $An_1$.

5. The method as defined in claim 4 wherein the linear ion trap comprises a first pair of rods, a second pair of rods and four auxiliary electrodes interposed between the first pair of rods and the second pair of rods and comprising a first pair of auxiliary electrodes and a second pair of auxiliary electrodes separated by a first plane bisecting one of the first pair of rods and the second pair of rods, the first axis lies in the first plane and the second axis is orthogonal to the first plane, establishing and maintaining the field comprises providing i) a first RF voltage to the first pair of rods at a first frequency and in a first phase, ii) a second RF voltage to the second pair of rods at a second frequency equal to the first frequency and in a second phase, opposite to the first phase, and iii) an auxiliary RF voltage to the first pair of auxiliary electrodes at an auxiliary frequency equal to the first frequency and shifted from the first phase by a phase shift, iv) a first DC voltage to the first pair of auxiliary electrodes, and v) a second DC voltage to the second pair of auxiliary electrodes, and the method further comprises axially ejecting a selected portion of the ions from the field, the selected portion of the ions having a selected m/z;

detecting the selected portion of the ions to provide a sliding mass signal peak centred about a sliding m/z ratio and adjusting at least one of i) the phase shift of the auxiliary RF voltage; ii) the first DC voltage provided to the first pair of auxiliary electrodes, iii) the second DC voltage provided to the second pair of auxiliary electrodes; and iv) the auxiliary RF voltage provided to the first pair of auxiliary electrodes; to slide the sliding m/z ratio toward the selected m/z.

6. The method as defined in claim 5 wherein establishing and maintaining the field comprises providing the second DC voltage to the second pair of auxiliary electrodes without providing an RF voltage to the second pair of auxiliary electrodes.

7. The method as defined in claim 5 wherein establishing and maintaining the field comprises providing a second auxiliary RF voltage to the second pair of auxiliary electrodes with the second DC voltage wherein the second auxiliary RF voltage is 180 degrees phase shifted relative to the auxiliary RF voltage provided to the first pair of auxiliary electrodes.

8. The method as defined in claim 5 further comprising adjusting the phase shift of the auxiliary RF voltage to slide the sliding m/z ratio toward the selected m/z.

9. The method as defined in claim 5 further comprising adjusting at least one of i) the first DC voltage provided to the first pair of auxiliary electrodes, and ii) the second DC voltage provided to the second pair of auxiliary electrodes to slide the sliding m/z ratio toward the selected m/z.

10. The method as defined in claim 5 wherein the phase shift is between −70 degrees and 70 degrees.

11. The method as defined in claim 5 wherein axially ejecting the selected portion of the ions having the selected m/z from the field comprises providing a quadrupole excitation AC voltage to the first pair of rods and the second pair of rods at a lower frequency than the first frequency to radially excite the selected portion of the ions having the selected m/z.

12. The method as defined in claim 5 wherein the linear ion trap further comprises an exit lens, and the four auxiliary electrodes are interposed between the first pair of rods and the second pair of rods in an extraction region defined along at least part of a length of the four rods, the method further comprising axially trapping the selected portion of the ions in the extraction region before axially ejecting the selected portion of the ions.

13. The method as defined in claim 12 wherein axially trapping the selected portion of the ions in the extraction region before axially ejecting the selected portion of the ions comprises providing a rod offset voltage to the first pair of rods and the second pair of rods, the rod offset voltage being higher than the DC voltage provided to the four auxiliary electrodes; and, providing a DC trapping voltage applied to the exit lens, wherein the rod offset voltage is lower than the DC trapping voltage applied to the exit lens.

14. The method as defined in claim 5 wherein axially ejecting the selected portion of the ions having the selected m/z from the field, comprises providing a dipolar excitation AC voltage to either the first pair of rods or a diagonally oriented pair of auxiliary electrodes at a lower frequency than the first frequency to radially excite the selected portion of the ions having the selected m/z; and the diagonally oriented pair of auxiliary electrodes are separated by both the first plane bisecting one of the first pair of rods and the second pair of rods, and a second plane orthogonal to the first plane and bisecting the other of the first pair of rods and the second pair of rods.

15. The method as defined in claim 5, further comprising, after axially ejecting the selected portion of the ions having the selected m/z from the field, axially ejecting a second selected portion of the ions from the field, the second selected portion of the ions having a second selected m/z;

detecting a second selected portion of the ions to provide a second sliding mass signal peak centered about a second sliding m/z ratio; and, adjusting at least one of i) the phase shift of the auxiliary frequency of the auxiliary RF voltage; ii) the first DC voltage provided to the first pair of auxiliary electrodes, iii) the second DC voltage provided to the second pair of auxiliary electrodes; and iv) the auxiliary RF voltage provided to the first pair of auxiliary electrodes; to slide the sliding m/z ratio toward the selected m/z.

16. The method as defined in claim 5 wherein adjusting the phase shift to slide the sliding m/z ratio toward the selected m/z comprises adjusting the phase shift based on changes to at least one of i) a magnitude of the first RF voltage; ii) a magnitude of the second RF voltage; and, iii) the first frequency, wherein the second frequency changes with the first frequency.

17. The method as defined in claim 4 wherein the linear ion trap comprises a first pair of rods, a second pair of rods and two auxiliary electrodes interposed between one of the first pair of rods and one of the second pair of rods and comprising a pair of auxiliary electrodes separated by a first plane bisecting either one of the first pair of rods and the second pair of rods, the first axis lies in the first plane and the second axis is orthogonal to the first plane, establishing and maintaining the field comprises providing i) a first RF voltage to the first pair of rods at a first frequency and in a first phase, ii) a second RF voltage to the second pair of rods at a second frequency equal to the first frequency and in a second phase, opposite to the first phase, and iii) an auxiliary RF voltage to the first pair of auxiliary electrodes at an auxiliary frequency equal to the first frequency and shifted from the first phase by a phase shift, and iv) a DC voltage to the pair of auxiliary electrodes, and the method further comprises axially ejecting a selected portion of the ions from the field, the selected portion of the ions having a selected m/z;

detecting the selected portion of the ions to provide a sliding mass signal peak centred about a sliding m/z ratio and adjusting at least one of i) the phase shift of the auxiliary RF voltage; ii) the DC voltage provided to the pair of auxiliary electrodes, and iii) the auxiliary RF voltage provided to the pair of auxiliary electrodes; to slide the sliding m/z ratio toward the selected m/z.

18. A linear ion trap system comprising:

a central axis;

a first pair of rods, wherein each rod in the first pair of rods is spaced from and extends alongside the central axis;

a second pair of rods, wherein each rod in the second pair of rods is spaced from and extends alongside the central axis;

four auxiliary electrodes interposed between the first pair of rods and the second pair of rods in an extraction region defined along at least part of a length of the first pair of rods and the second pair of rods, wherein the four auxiliary electrodes comprise a first pair of auxiliary electrodes and a second pair of auxiliary electrodes, and the first pair of auxiliary electrodes are separated by, and are adjacent to, a single rod in either the first pair of rods or the second pair of rods generating an asymmetric substantially quadrupole field; and, a voltage supply connected to the first pair of rods, the second pair of rods and the four auxiliary electrodes, wherein the voltage supply is operable to provide i) a first RF voltage to the first pair of rods at a first frequency and in a first phase, ii) a second RF voltage to the second pair of rods at a second frequency equal to the first frequency and in a second phase, opposite to the first phase, iii) an auxiliary RF voltage to the first pair of auxiliary electrodes at an auxiliary frequency equal to the first frequency and shifted from the first phase by a phase shift, iv) a first DC voltage to the first pair of auxiliary electrodes, and v) a second DC voltage to the second pair of auxiliary electrodes.

19. The linear ion trap system as defined in claim 18, wherein the voltage supply comprises a first voltage source operable to provide the first RF voltage to the first pair of rods; a second voltage source operable to provide the second RF voltage to the second pair of rods; an auxiliary voltage source operable to provide the auxiliary RF voltage to the first pair of auxiliary electrodes, and a phase controller for controlling a phase and a phase shift of the auxiliary voltage provided by the auxiliary RF voltage source.

20. A linear ion trap system comprising:

a central axis;

a first pair of rods, wherein each rod in the first pair of rods is spaced from and extends alongside the central axis;

a second pair of rods, wherein each rod in the second pair of rods is spaced from and extends alongside the central axis;

two auxiliary electrodes interposed between one of the first pair of rods and one of the second pair of rods in an extraction region defined along at least part of a length of the first pair of rods and the second pair of rods, wherein the two auxiliary electrodes comprise a pair of auxiliary electrodes, and the pair of auxiliary electrodes are separated by, and are adjacent to, a single rod from the first pair of rods and a single rod from the second pair of rods generating an asymmetric substantially quadrupole field; and, a voltage supply connected to the first pair of rods, the second pair of rods and the two auxiliary electrodes, wherein the voltage supply is operable to provide i) a first RF voltage to the first pair of rods at a first frequency and in a first phase, ii) a second RF voltage to the second pair of rods at a second frequency equal to the first frequency and in a second phase, opposite to the first phase, iii) an auxiliary RF voltage to the pair of auxiliary electrodes at an auxiliary frequency equal to the first frequency and shifted from the first phase by a phase shift, and iv) a DC voltage to the first pair of auxiliary electrodes.

* * * * *